US008372572B2

(12) United States Patent
Toizumi et al.

(10) Patent No.: US 8,372,572 B2
(45) Date of Patent: Feb. 12, 2013

(54) TONER, TWO-COMPONENT DEVELOPER, DEVELOPING DEVICE AND IMAGE FORMING APPARATUS

(75) Inventors: Kiyoshi Toizumi, Nara (JP); Satoru Ariyoshi, Nara (JP); Yasuhiro Shibai, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 13/295,483

(22) Filed: Nov. 14, 2011

(65) Prior Publication Data

US 2012/0070775 A1 Mar. 22, 2012

Related U.S. Application Data

(62) Division of application No. 12/188,554, filed on Aug. 8, 2008.

(30) Foreign Application Priority Data

Aug. 9, 2007 (JP) ..... P2007-208520

(51) Int. Cl.
*G03G 9/08* (2006.01)

(52) U.S. Cl. ..... 430/137.1; 430/137.21

(58) Field of Classification Search ..... 430/137.1, 430/137.21

See application file for complete search history.

(56) References Cited

U.S. PATENT DOCUMENTS

| | | | | |
|---|---|---|---|---|
| 2003/0148203 | A1* | 8/2003 | Suzuki et al. | 430/110.3 |
| 2004/0058258 | A1 | 3/2004 | Yoshino et al. | |
| 2004/0067189 | A1 | 4/2004 | Sugiura et al. | |
| 2005/0221206 | A1 | 10/2005 | Takayama et al. | |
| 2005/0238988 | A1 | 10/2005 | Sugahara et al. | |
| 2006/0024604 | A1 | 2/2006 | Sugiura et al. | |
| 2006/0171872 | A1 | 8/2006 | Adams | |
| 2006/0202125 | A1 | 9/2006 | Suhami | |
| 2007/0031749 | A1 | 2/2007 | Hu et al. | |
| 2007/0065183 | A1 | 3/2007 | Tomita | |
| 2007/0201917 | A1 | 8/2007 | Teshigawara | |
| 2007/0218387 | A1 | 9/2007 | Ishii et al. | |
| 2009/0042121 | A1 | 2/2009 | Toizumi et al. | |

FOREIGN PATENT DOCUMENTS

| | | | |
|---|---|---|---|
| JP | 01237561 | A | 9/1989 |
| JP | 2004-93829 | A | 3/2004 |
| JP | 2004-102236 | A | 4/2004 |
| JP | 2006-106801 | A | 4/2006 |
| JP | 2006-206413 | A | 8/2006 |
| JP | 2006-308642 | A | 11/2006 |
| JP | 2007-147979 | A | 6/2007 |

OTHER PUBLICATIONS

Abstract of JP 01237561 A Sep. 1989.

* cited by examiner

*Primary Examiner* — Hoa V Le
(74) *Attorney, Agent, or Firm* — Nixon & Vanderhye P.C.

(57) ABSTRACT

A toner capable of ensuring cleanness and the amount of specific charge for extended periods of time and having excellent charge stability and fixing property, a two-component developer, a developing device and an image forming apparatus are provided. A toner includes toner particles containing at least a binding resin and a coloring agent, and fine silicon-containing oxide particles having an average primary particle size of not smaller than 70 nm but not larger than 150 nm and containing water in an amount of not larger than 2.0% by weight, the fine silicon-containing oxide particles being externally added to the toner particles.

7 Claims, 2 Drawing Sheets

TONER, TWO-COMPONENT DEVELOPER, DEVELOPING DEVICE AND IMAGE FORMING APPARATUS

CROSS-REFERENCE TO RELATED APPLICATION

The present application is a divisional of U.S. application Ser. No. 12/188,554 (pending), which was filed on Aug. 8, 2008 (published as 2009-0042121-A1 on Feb. 12, 2009), which claims priority to Japanese Patent Application No. 2007-208520, which was filed on Aug. 9, 2007, the entire contents of each of which are hereby incorporated by reference.

BACKGROUND OF THE INVENTION

1. Field of the Invention

The present invention relates to a toner, a two-component developer, a developing device and an image forming apparatus.

2. Description of the Related Art

In recent years, efforts have been made extensively in an attempt to improve the quality of images formed by visualizing the latent images by using an image forming apparatus. As one of the concrete tendencies, the developer has been improved, particularly, by decreasing particle sizes of the toner in order to enhance the resolution and vividness. However, a decrease in the particle size of the toner is accompanied by a decrease in the transfer property and cleanness often deteriorating the quality of images.

In order to cope with, the above problems, it has been attempted to improve the transfer property and cleanness by adding an external additive as spacer onto the surfaces of the toner. However, the function of the spacer cannot be drawn to a sufficient degree unless the particle size and properties of the external additive are controlled.

If the average primary particle size of the external additive is too small the spacer effect is not obtained between the toner and the surface of the photoreceptor drum or the transfer belt (inclusive of both the transfer system directly onto the paper or the intermediate transfer belt system). Therefore, the adhering force of the toner increases and the cleanness cannot be ensured. If the average primary particle size is too large, the number of the external additive particles of large particle sizes increases and the amount of specific charge of the toner decreases. This is attributed to that the spacer effect becomes too great between the toner and the carrier due to the external additive, whereby the contact becomes defective between the toner and the carrier and the electric charge becomes poor. It is further considered that the external additive separates away from the toner particles in increased amounts making it difficult to ensure the amount of specific charge of the toner.

Japanese Unexamined Patent Publication JP-A 2004-102236 discloses a technology for obtaining the inherent function of the external additive by using, as an external additive for toner, fine oxide particles of substantially a spherical shape containing, at least, silicon element, having a number average primary particle size R of 30 to 300 nm, a standard deviation $\sigma$ in the particle size distribution R of $R/4 \leqq \sigma \leqq R$, having a circularity degree SF1 of 100 to 130, a circularity degree SF2 of 100 to 125, the fine oxide particles exhibiting a spacer effect to a sufficient degree, preventing the additive from being buried at the time when the toner is preserved at high temperatures or when the toner is deteriorated by vigorous stirring, while suitably setting the ratio of containing fine oxide particles of large particle sizes, intermediate particle sizes and small particle sizes, ensuring fluidity relying upon the particles of small particle sizes, effectively drawing out the spacer effect relying upon the particles of intermediate particle, large particle sizes, improving the fluidity of the toner, enhancing the affinity of the toner and of the fine oxide particles, and preventing the separation of the fine oxide particles from the toner.

However, JP-A 2004-102236 is not giving consideration to the amount of water in the fine oxide particles. The fine oxide particles having the average primary particle size of about 100 nm usually contain water in an amount of 5 to 8%. If the amount of water increases in the fine oxide particles, the electric charge leaks to the surfaces of the carrier via the fine oxide particles causing the occurrence of such problems as a decrease in the amount of electric charge of the toner through the endurance printing test, deterioration in the image quality and scattering of toner is the apparatus. Further, the fine oxide particles have a wide particle size distribution. If the amount of addition of the fine oxide particles is increased in order to ensure cleanness, therefore, the amount of fine oxide particles of small particle sizes increases, adversely affecting the fixing property.

SUMMARY OF THE INVENTION

An object of the present invention is to provide a toner capable of ensuring cleanness and the amount of specific charge of the toner for extended periods of time by solving the above problems and having excellent charge stability and fixing property, as well as to provide a two-component developer, a developing device and an image forming apparatus.

The invention provides a toner comprising:

toner particles containing at least a binding resin and a coloring agent; and fine silicon-containing oxide particles having an average primary particle size of not smaller than 70 nm but not larger than 150 nm and containing water in an amount of not larger than 2.0% by weight, the fine silicon-containing oxide particles being externally added to the toner particles.

According to the invention, the toner is obtained by externally adding fine silicon-containing oxide particles having an average primary particle size of not smaller than 70 nm but not larger than 150 nm and containing water in an amount of not larger than 2.0% by weight to toner particles that contain at least a binding resin and a coloring agent.

Since the average primary particle size is not smaller than 70 nm but is not larger than 150 nm, the spacer effect works between the toner and the surface of the photoreceptor drum or the transfer belt, and the toner adheres little onto the photoreceptor drum or onto the transfer belt. Therefore, cleanness is ensured over extended periods of time. Further, a decrease in the amount of specific charge of the toner is prevented in the endurance printing test, and excellent charge stability is obtained. This makes it possible to suppress a decrease in the quality of the printed image and to decrease the amount of the toner that scatters in the apparatus. Further, the amount of the fine silicon-containing oxide particles is decreased on the side of small particle sizes contributing to attaining better fixing property.

Since the water is contained in an amount not larger than 2.0% by weight, the electric charge is prevented from leaking to the surface of the carrier via the fine silicon-containing oxide particles, and a decrease in the amount of specific charge of the toner is prevented.

Further, since the fine oxide particles contain silicon, the charging property can be suitably adjusted and the toner features further improved charge stability.

Further, in the invention, it is preferable, that a particle size distribution of the fine silicon-containing oxide particles is a monodispersion.

According to the invention, in the case where a particle size distribution of the fine silicon-containing oxide particles is a monodispersion, since the number of the fine silicon-containing oxide particles decreases on the side of small particle sizes and on the side of large particle sizes, cleanness is ensured on the photoreceptor drum and on the transfer belt, and a decrease in the amount of specific charge of the toner is prevented in the endurance printing testing, offering excellent charge stability. In particular, the fixing property is ensured since the amount of the fine silicon-containing oxide particles decreases particularly on the side of small particle sizes.

Further, in the invention, it is preferable that the fine silicon-containing oxide particles are treated to be hydrophobic.

According to the invention, in the case where the fine silicon-containing oxide particles are treated to be hydrophobic, since cleanness is ensured on the photoreceptor drum and on the transfer belt and, besides, since a variation in the amount of specific charge of the toner is suppressed in a high-temperature and high-humidity environment and in a low-temperature and low-humidity environment, excellent charge stability is obtained.

Further, in the invention, it is preferable that the fine silicon-containing oxide particles have a specific surface area of not smaller than 20 $m^2/g$ but not larger than 50 $m^2/g$.

According to the invention, in the case where the fine silicon-containing oxide particles have a specific surface area of not smaller than 20 $m^2/g$ but not, larger than 50 $m^2/g$, since cleanness is ensured on the photoreceptor drum and on the transfer belt and, besides, since a decrease in the amount of specific charge of the toner is prevented in the endurance printing test, excellent charge stability is obtained. In particular, since the amount of the fine silicon-containing oxide particles decreases on the side of small particle sizes, fixing property is ensured.

Further, in the invention, it is preferable that the fine silicon-containing oxide particles are added in an amount of not less than 0.5 part by weight but not more than 3.0 parts by weight based on 100 parts by weight of the toner particles.

According to the invention, in the case where the fine silicon-containing oxide particles are added in an amount of not less than 0.5 part by weight but not more than 3.0 parts by weight based on 100 parts by weight of the toner particles, since cleanness is ensured on the photoreceptor drum and on the transfer belt and, besides, since a decrease in the amount of specific charge of the toner is prevented in the endurance printing test, excellent charge stability is obtained. In particular, since the amount of the fine silicon-containing oxide particles decreases on the side of small particle sizes, fixing property is ensured.

Further, in the invention, it is preferable that the toner has a volume average particle size of not smaller than 4 μm but not larger than 8 μm.

According to the invention, in the case where the toner has a volume average particle size of not smaller than 4 μm but not larger than 8 μm, since cleanness is ensured on the photoreceptor drum and on the transfer belt and, besides, since a decrease in the amount of specific charge of the toner is prevented in the endurance printing test, excellent charge stability is obtained.

Further, in the invention, it is preferable that the toner comprises one or more kinds of fine particles having an average primary particle size smaller than that of the fine silicon-containing oxide particles.

According to the invention, in the case where the toner comprises one or more kinds of fine particles having an average primary particle size smaller than that of the fine silicon-containing oxide particles, by using the fine silicon-containing oxide particles and the fine particles having a smaller average primary particle size in combination, the fluidity of the toner can be ensured, the specific charge of the toner in the developer can be quickly increased, and the quality of the printed image can be stabilized.

Further, the invention provides a two-component developer containing the toner mentioned above and a carrier.

According to the invention, it is preferable that the two-component developer contains the toner and a carrier.

By using the toner of the invention as the two-component developer, the amount of specific charge of the toner is stabilized and the printed image has stable quality.

Further, the invention provides a developing device for effecting the developing by using a developer containing the toner mentioned above or the two-component developer mentioned above.

According to the invention, it is preferable that the developing device effects the developing by using the developer containing the toner mentioned above or the two-component developer that exhibits the above effect.

Upon effecting the developing by using the developer of the present invention, a highly fine toner image having high resolution can be formed on the photoreceptor without causing a defect in the developing that stems from a decrease in the amount of specific charge of the toner after used for extended periods of time.

Further, the invention provides an image forming apparatus for forming an image by using the developing device mentioned above.

According to the invention, further, it is preferable that the image forming apparatus forms an image by using the developing device that exhibits the above effect.

Upon forming images by using the developing device of the invention, images of high quality can be obtained without a decrease in the quality that stems from poor cleanness and from a decrease in the amount of specific charge of the toner after used for extended periods of time.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
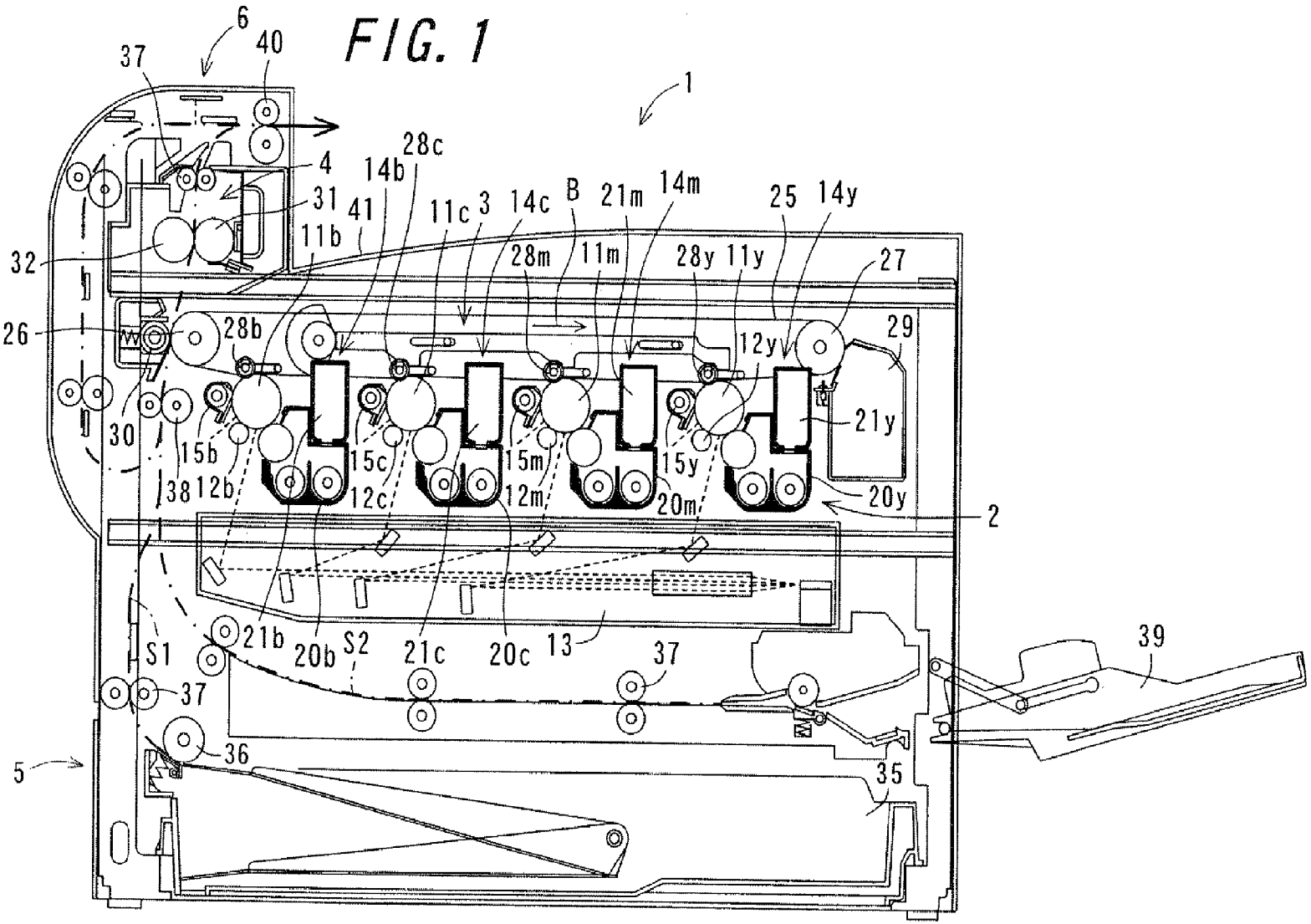
FIG. 1 is a view schematically illustrating the constitution of an image forming apparatus according to the invention.

Now referring to the drawings, preferred embodiments of the invention are described below.

The toner of the invention comprises toner particles containing at least a binding resin and a coloring agent; and fine silicon-containing oxide particles having an average primary particle size of not smaller than 70 nm but not larger than 150 nm and containing water in an amount of not larger than 2.0% by weight, the fine silicon-containing oxide particles being externally added to the toner particles.

[Toner Particles]

The toner particles contain at least a binder resin and a coloring agent, and may further contain any other toner additives such as a release agent and a charge control agent.

There is no particular limitation on the binder resin as long as it is the one that is usually used as a binder resin for toner and can be granulated in a molten state. Known binder resins may be used each alone or two or more of them may be used in combination.

For example, there can be used polyvinyl chloride, polyvinyl acetate, polyethylene, polypropylene, polyester, polyamide, styrene polymer, (meth)acrylic resin, polyvinyl butylal, silicone resin, polyurethane, epoxy resin, phenol resin, xylene resin, rosin-modified resin, terpene resin, aliphatic hydrocarbon resin, alicyclic hydrocarbon resin, aromatic petroleum resin, chlorinated paraffin and paraffin wax. The binder resins may be used each alone or two or more of them may be used in combination. Among them, it is preferred to use polyester, styrene polymer or (meth)acrylic resin acid of which the particle surfaces can be easily smoothed by the wet granulation in an aqueous system.

As the polyester, it is preferable to use a polycondensed product of a polyhydric alcohol and a polyhydric carboxylic acid. As the polyhydric alcohol, there can, be exemplified aliphatic alcohols such as ethylene glycol, propylene glycol, 1,3-butanediol, 1,4-butanediol, 2,3-butanediol, diethylene glycol, 1,5-pentanediol, 1,6-hexanediol and neopentyl glycol; alicyclic alcohols such as cyclohexanedimethanol and hydrogenated bisphenol; and bisphenol A alkylene oxide adduct such as bisphenol A ethylene oxide adduct and bisphenol A propylene oxide adduct. The polyhydric alcohols may be used each alone or two or more of the may be used in combination. As the polyhydric carboxylic acid, there can be used aromatic carboxylic acids and acid anhydrides thereof, such as phthalic acid, terephthalic acid and phthalic anhydride; and saturated and unsaturated aliphatic carboxylic acids and acid anhydrides thereof, such as succinic acid, adipic acid, sebacic acid, azelaic acid and dodecenylsuccinic acid. The polyhydric carboxylic acids can be used each alone or two or more of them may be used in combination.

As the styrene polymer, there can be used a homopolymer of a styrene monomer, or a copolymer of a styrene monomer and a monomer copolymerizable with the styrene monomer. As the styrene monomer, there can be exemplified styrene, o-methylstyrene, ethylstyrene, p-methoxystyrene, p-phenylstyrene, 2,4-dimethylstyrene, p-n-octylstyrene, p-n-decylstyrene and p-n-dodecylstyrene. Other monomers may be (meth) acrylic acid esters such as methyl(meth)methacrylate, ethyl (meth)acrylate, propyl(meth)acrylate, butyl(meth)acrylate, isobutyl(meth)acrylate, n-octyl(meth)acrylate, dodecyl (meth)acrylate, 2-ethylhexyl(meth)acrylate, stearyl(meth) acrylate, phenyl(meth)acrylate, and dimethylaminoethyl (meth)acrylate; (meth)acrylic monomers such as acrylonitrile, methacrylamide, glycidylmethacrylate, N-methylolacrylamide, N-methylolmethacrylamide, and 2-hydroxyethylacrylate; vinyl ethers such as vinylmethyl ether, vinylethy ether and vinylisobutyl ether; vinylketones such as vinylmethylketone, vinylhexylketone, and methylisopropenylketone; and N-vinyl compounds such as N-vinylpyrrolidone, N-vinylcarbasole, and N-vinylindole. The styrene monomers and the monomers copolymerizable with the styrene monomers can be used each alone or two or more of them may be used in combination.

As the (meth)acrylic resin, there can be exemplified homopolymes of (meth)acrylic acid esters and copolymers of (meth)acrylic acid esters and monomers copolymerizable with the (meth)acrylic acid esters. As the (meth)acrylic acid esters, there can be used those described above. As the monomers copolymerizable with the (meth)acrylic acid esters, there can be used (meth)acrylic monomers, vinyl ethers, vinylketones and N-vinyl compounds. They may be those described above.

It is also allowable to bond a hydrophilic group such as carboxyl group or sulfonic acid group to the main chain or the side chain of the binder resin in order to use it as a binder resin having self-dispersing property in water.

As the coloring agents, there can be used, for example, black color type pigments and chromatic type pigments. As the black color type pigments, there can be used black color type inorganic pigments, such as carbon black, copper oxide, manganese dioxide, active carbon, nonmagnetic ferrite, magnetic ferrite and magnetite, as well as black color type organic pigments such as aniline black.

As the chromatic type pigments, there can be exemplified:

yellow type inorganic pigments, such as chrome yellow, zinc yellow, cadmium yellow, yellow iron oxide, mineral fast yellow, nickel titanium yellow and navel yellow;

yellow type organic pigments, such as naphthol yellow S, Hansa Yellow G, Hansa Yellow 10G, Benzidine Yellow G, Benzidine Yellow GR, quinoline yellow lake, permanent yellow NCG and Tartrazine Lake;

orange type inorganic pigments, such as red chrome yellow and molybdenum orange; orange type organic pigments, such as permanent orange GTR, pyrazolone orange, Vulcan Orange, Indanthrene Brilliant Orange RK, Benzidine Orange G and Indanthrene Brilliant Orange GK;

red type inorganic pigments, such as red iron oxide, cadmium red, red lead, mercury sulfide and cadmium;

red type organic pigments, such as permanent red 4R, Lithol Red, Pyrazolone Red, Watchung Red, calcium salt, lake red C, lake red D, Brilliant Carmine 6B, eosine lake, Rhodamine Lake B, Alizarine Lake and Brilliant Carmine 3B;

violet type inorganic pigments, such as manganese violet;

violet type organic pigments, such as fast violet B and methyl violet lake;

blue type inorganic pigments, such as Prussian blue and cobalt blue;

blue type organic pigments, such as alkali, blue lake, Victoria blue lake, Phthalocyanine Blue, non-metallic Phthalocyanine Blue, partial chloride of Phthalocyanine Blue, fast sky blue and Indanthrene Blue BC;

green type inorganic pigments, such as chrome green and chromium oxide; and green type organic pigments, such as pigment green B, malachite green lake and final yellow green G. The coloring agents can be used each alone or two or more of them may be used in combination.

Two or more of the coloring agents of the same type of color may be used in combination, or those of different types of colors may be used being mixed together. The content of the coloring agent is, preferably, 1 to 20% by weight and, more preferably, 0.2 to 10% by weight based on the whole amount of toner particles.

It is preferable that the coloring agent is used as a masterbatch. The masterbatch of the coloring agent can be prepared by, for example, kneading a molten synthetic resin and the coloring agent. As the synthetic resin, there can be used a resin the same as the binder resin for the toner or a resin having good compatibility to the binder resin for the toner. There is no particular limitation on the ratio of using the synthetic resin and the coloring agent. Preferably, however, the coloring agent is used in an amount of not less than 30 parts by weight but not more than 100 parts by weight based on 100 parts by weight of the synthetic resin. The masterbatch is used being granulated to a particle size of, for example, about 2 to about 3 mm.

As the release agent, there can be used the one that is usually used in this field of art. For example, there can be used petroleum type waxes such as paraffin wax or derivatives thereof and microcrystalline wax or derivatives thereof; hydrocarbon type synthetic waxes such as Fischer-Tropsch wax and derivatives thereof, polyolefin wax and derivatives thereof, low-molecular polypropylene wax and derivatives thereof and polyolefin polymer wax (low-molecular polyethylene wax, etc.) and derivatives thereof; plant type waxes such as carnauba wax and derivatives thereof, rice wax and derivatives thereof, candelilla wax and derivatives thereof and Japan wax; animal type waxes such as bees wax and whale wax; oil and fat type synthetic waxes such as fatty acid amide and phenolic fatty acid ester; as well as long-chain carboxylic acid and derivatives thereof, long-chain alcohol and derivatives thereof, silicone polymer and higher fatty acid. The derivatives may contain oxides, block copolymers of vinyl monomer and wax, and graft-modified products of vinyl monomer and wax. The amount of using the wax can be suitably selected over a wide range without any particular limitation. Preferably, however, the wax is used in a an amount of 0.2 to 20% by weight based on the whole amount of the fine resin particles.

As the charge control agent, there can be there can be used, for example, metal-containing azo dyes (chrome/azo complex dye, iron azo complex dye, cobalt/azo complex dye, etc.); copper phthalocyanine dye; metal (chrome, zinc, aluminum, boron, etc.) complexes of salicylic acid and alkyl derivative thereof and salts thereof; metal (chrome, zinc, aluminum, boron, etc.) complexes of naphtholic acid and derivative thereof and salts thereof; metal (chrome, zinc, aluminum, boron, etc.) complexes of benzylic acid and derivative thereof and salts thereof; charge control agents for negatively charging toner, such as long-chain alkylcarboxylate and long-chain alkylsulfonate; Nigrosine dye and derivatives thereof, benzoguanamine, triphenylmethane derivative, quaternary ammonium salt, quaternary phosphonium salt, quaternary pyridinium salt, guanidine salt, amidine salt; and radically polymerizable copolymers of monomers having nitrogen-containing functional groups [N,N-dialkylaminoalkyl(meth) acrylates such as N,N-dimethylaminomethyl(meth)acrylate, N,N-dimethylaminoethyl(meth)acrylate and N,N-diethylaminoethyl(meth)acrylate, and N,N-dialkylaminoalkyl (meth)acrylamides such as N,N-dimethylaminoethyl(meth) acrylamide and N,N-dimethylaminopropyl(meth) acrylamide]. The charge control agents can be used each alone or two or more of them may be used in combination. The content of the charge control agent is, preferably, 0.1 to 5.0% by weight based on the whole amount of the toner particles.

The toner particles can be obtained by a known production method without any particular limitation.

The toner particles can be produced by, for example, a melt-kneading pulverization method according to which a binder resin, a coloring agent, a release agent, a charge control agent and any other additives are dry-mixed together in predetermined amounts, the obtained mixture is melt-kneaded, the obtained melt-kneaded product is cooled and solidified, and the obtained solidified product is mechanically pulverized.

As the mixer used for dry-mixing, there can be used a Henschel type mixer, such as HENSCHELMIXER (trade name, manufactured by Mitsui Mining Co., Ltd.), SUPERMIXER (trade name, manufactured by Kawata MFG Co., Ltd.) and MECHANOMIL (trade name, manufactured by Okada Seiko Co., Ltd.); ANGMIL (trade name, manufactured by Hosakawa Micron Corporation), HYBRIDIZATION SYSTEM (trade name, manufactured by Nara Machinery Co., Ltd.), and COSMOSYSTEM (trade name, manufactured by Kawasaki Heavy Industries, Ltd.)

The kneading is effected with stirring while being heated at a temperature (usually, about 80 to about 200° C., preferably, about 100 to about 150° C.) higher than the melting temperature of the binder resin. A generally employed kneader can be used, such as biaxial extruder, three-roll mill or Laboplustomill. More concretely, there can be used a monoaxial or biaxial extruder such as TEM-100B (trade name, manufactured by Toshiba Machine Co., Ltd.) or PCM-65/87 (trade name, manufactured by Ikegai, Ltd.), or the one of the open roll system such as Kneadex (trade name, manufactured by Mitsui Mining Co., Ltd.) Among them, the one of the open roll system is preferred.

The solidified product obtained by cooling the melt-kneaded product is pulverized by using a cutter mill, a Feather mill or a jet mill. For example, the solidified product is coarsely pulverized by using the cutter mill and is, next, pulverized by the jet mill to obtain a toner having a desired volume average particle size.

The toner particles can be further produced by, for example, coarsely pulverizing the solidified product of the melt-kneaded product, forming an aqueous slurry of the obtained coarsely pulverized product, atomizing the obtained aqueous slurry by using a high-pressure homogenizer, and heating, aggregating and melting the obtained fine particles in an aqueous medium.

The solidified product of the melt-kneaded product is coarsely pulverized by using, for example, the jet mill or the hand mill. Through the rough pulverization, coarse particles having a particle size of about 100 μm to about 3 mm is obtained. The coarse particles are dispersed in water to prepare an aqueous slurry thereof. To disperse the coarse particles in water, a dispersant such as sodium dodecylbenzenesulfonate or the like is dissolved in a suitable amount in water to obtain an aqueous slurry in which the coarse particles are homogeneously dispersed. Upon treating the aqueous slurry by using a high-pressure homogenizer, the coarse particles in the aqueous slurry are atomized; i.e., an aqueous slurry is obtained containing fine particles having a volume average particle size of about 0.4 to about 1.0 μm. The aqueous slurry is heated to aggregate fine particles which are, then, melt-bonded together to obtain a toner having a desired volume average particle size and an average circularity degree.

The volume average particle size and the average circularity degree can be adjusted to desired values by, for example, suitably selecting the temperature for heating the aqueous slurry of fine particles and the time for heating. The heating temperature is suitably selected from a temperature range which is not lower than the softening temperature of the binder resin but is lower than the thermal decomposition temperature of the binder resin. If the time for heating is the same, the volume average particle size of the toner, usually, increases with an increase in the heating temperature.

As the high-pressure homogenizer, there have been known those placed in the market. As the high-pressure homogenizer placed in the market, there can be exemplified chamber-type high-pressure homogenizers such as MICROFLUIDIZER (trade name, manufactured by Microfluidics Corporation), NANOMIZER (trade name, manufactured by Nanomizer Inc.) and ALTIMIZER (trade name, manufactured by Sugino Machine Ltd.), as well as HIGH-PRESSURE HOMOGENIZER (trade name, manufactured by Rannie Inc.), HIGH- PRESSURE HOMOGENIZER (trade name, manufactured by Sanmaru Machinery Co., Ltd.), HIGH-PRESSURE HOMOGENIZER (trade name, manufactured by Izumi Food Machinery Co., Ltd.) and NANO3000 (trade name, manufactured by Beryu Co., Ltd.)

The thus produced toner may be subjected to the spheroidizing treatment. As the spheroidizing device, a shock type spheroidizing device and the hot air type spheroidizing device can be exemplified. The shock type spheroidizing device may be the one that has been placed in the market, such as FACULTY (trade name, manufactured by Hosokawa Micron Corporation) and HYBRIDIZATION SYSTEM (trade name, manufactured by Nara Machinery Co., Ltd.) The hot air type spheroidizing device may also be the one placed in the market, such as a surface reforming machine, Meteorainbow (trade name, manufactured by Nippon Pneumatic MFG Co., Ltd.)

[Fine Silicon-Containing Oxide Particles]

The fine silicon-containing oxide particles are used as an external additive that is to be externally added to the toner particles, and exhibit the functions of improving the powder fluidity, improving friction charging property, heat resistance, improving long term preservation property, improving cleanness and controlling wear properties on the surface of the photoreceptor.

The fine silicon-containing oxide particles have an average primary particle size of not smaller than 70 nm but not larger than 150 nm, and contains water in an amount of not more than 2.0% by weight, preferably, not more than 1.5% by weight and, more preferably, not more than 1.0% by weight.

Since the average primary particle size is not smaller than 70 nm but is not larger than 150 nm, spacer effect works between the toner and the surfaces of the photoreceptor drum and of the transfer belt. Therefore, the toner adheres little on the photoreceptor drum or on the transfer belt, and cleanness is ensured over extended periods of time. Further, a decrease in the amount of specific charge of the toner is prevented in the endurance printing test, and excellent charge stability is obtained. Accordingly, a decrease in the quality of the printed image is suppressed, and the toner scatters in decreased amounts in the apparatus. Further, fixing property is ensured since the amount of the fine silicon-containing oxide particles is decreased on the side of small particle sizes.

Since the amount of water is not larger than 2.0% by weight, the electric charge is prevented from leaking to the surface of the carrier via the fine silicon-containing oxide particles, and the amount of specific charge of the toner is prevented from decreasing.

Further, since the fine oxide particles contain silicon, the charging property can be suitably adjusted and the toner features further improved charge stability.

If the average primary particle size is smaller than 70 nm, cleanness is not ensured and besides, fine particles having an average primary particle size of not larger than 30 nm increase to impair fixing property. If the average primary particle size exceeds 150 nm, the particles of large particle sizes increase giving rise to the occurrence of defective contact between the toner and the carrier, and the amount of specific charge of the toner decreases.

If the amount of water exceeds 2.0% by weight, the electric charge leaks to the surface of the carrier via the fine silicon-containing oxide particles, and the amount of specific chare of the toner decreases.

The average primary particle size can be measured by using a particle size distribution-measuring apparatus that utilizes dynamic scattering of light, such as DLS-800 (trade name, manufactured by Otsuka Electronics Co., Ltd.) and Coulter N4 (trade name, manufactured by Coulter Electronics Ltd.). However, since it is difficult to dissociate the secondary aggregation of particles that have been treated to be hydrophobic, it is preferable to directly find the average primary particle size by analyzing the image photographed by using a scanning electron microscope (SEM) or a transmission electron microscope (TEM).

The amount of water is calculated from the amount of water that is generated upon being heated at 105° C. by using the Karl-Fischer amount-of-water measuring apparatus (e.g., trade name: CA-100, manufactured by Mitsubishi Chemical Corporation)

It is preferable that the particle size distribution of the fine silicon-containing oxide particles is a monodispersion. The number of the fine silicon-containing oxide particles decreases on the side of small particle sizes and on the side of large particle sizes. Therefore, cleanness is ensured on the photoreceptor drum and on the transfer belt, and the amount of specific charge of the toner is prevented from decreasing in the endurance printing test, offering excellent charge stability. In particular, since the amount of the fine silicon-containing oxide particles decreases on the side of small particle sizes, fixing property can be ensured.

In the case of a multiple dispersion including fine silicon-containing oxide particles on the side of small particle sizes, fixing property deteriorates. In the case of the multiple dispersion including fine silicon-containing oxide particles having an average primary particle size of not smaller than 150 nm, in particular, toner, charging becomes defective.

Here, the particle size distribution is found by analyzing the image photographed by using the scanning electron microscope.

It is preferable that the fine silicon-containing oxide particles have a specific-surface area of not smaller than 20 $m^2/g$ but not larger than 50 $m^2/g$. Cleanness is ensured on the photoreceptor drum and on the transfer belt, and the amount of specific charge of the toner is prevented from decreasing in the endurance printing test offering excellent charge stability. In particular, since the amount of the fine silicon-containing oxide particles decreases on the side of small particle sizes, fixing property can be ensured.

If the specific surface area is smaller than 20 $m^2/g$, the amount of silicone-containing fine oxide particles of large particle sizes increases causing defective contact between the toner and the carrier, and decreasing the amount of specific charge of the toner.

If the specific surface area exceeds 50 $m^2/g$, the amount of silicone-containing fine oxide particles of small particle sizes increases causing a decrease in the toner fixing property.

Here, the BET specific surface area is measured relying upon the BET three-point method by finding a gradient A from the nitrogen adsorption amounts for the three relative pressure points and by finding a specific surface value from the BET formula.

The fine silicon-containing oxide particles of the invention can be produced by a known production method without any particular limitation.

The fine silicon-containing oxide particles can be produced by a sol-gel method. For example, a sol of alkoxysilane is subjected to the hydrolysis/polycondensation reaction to turn it into a gel without fluidity, and the gel is subjected to the filtration and centrifugal separation followed by beating to remove the solvent by evaporation.

The alkoxysilane is represented by the general formula, $R^1{}_aSi(OR^2)_{e-a}$ (wherein $R^1$ and $R^2$ are monovalent hydrocarbon groups having 1 to 4 carbon atoms, and a is an integer of 0 to 4) and is, for example, tetramethoxysilane, tetraethoxysilane, tetrapropoxysilane, tetrabutoxysilane, methyltrimethoxysilane, methyltriethoxysilane, methyltripropoxysilane, methyltributoxysilane, ethyltrimethoxysilane, ethyltriethoxysilane, ethyltripropoxysilane, ethyltributoxysilane, propyltrimethoxysilane, propyltriethoxysilane, butyltrimethoxysilane, butyltriethoxysilane, dimethyldimethoxysilane, dimethyldiethoxysilane, dimethyldipropoxysilane, dimethyldibutoxysilane, diethyldimethoxysilane, diethyldiethoxysilane, diethyldipropoxysilane, diethyldibutoxysilane, dipropyldimethoxysilane, dipropyldiethoxysilane, dibutyldimethoxysilane, dibutyldiethoxysilane, trimethylmethoxysilane, trimethylethoxysilane, trimethylpropoxysilane, trimethylbutoxysilane, triethylmethoxysilane, triethylethoxysilane, triethylpropoxysilane, triethylbutoxysilane, tripropylmethoxysilane, tripropylethoxysilane, tributylmethoxysilane and tributylethoxyslane. Among them, tetramethoxsilane and methyltrimethoxysilane are particularly preferred.

As the organic solvent, there can be used alcohols such as methanol, ethanol, 1-propanol, 2-methoxyethanol, 2-ethoxythanol and 1-butanol.

As the catalyst for hydrolysis, there can be used ammonia, urea or monoamine.

The fine silicon-containing oxide particles are treated to be hydrophobic to improve environmental charge stability. Cleanness is ensured on the photoreceptor drum and on the transfer belt, and a change in the amount of specific charge of the toner is suppressed in an environment of a high temperature and a high humidity and a low temperature and a low humidity, offering excellent charge stability.

As the hydrophobic property-imparting agent, there can be used, for example, silane coupling agent, silylating agent, silane coupling agent having a fluorinated alkyl group, organotitanate coupling agent, aluminum coupling agent, silicone oil or silicone varnish.

Among them, a hydrophobic property-imparting treatment is particularly preferred by introducing an $R^3{}_3SiO_{1/2}$ unit into the surface. Here, $R^3$ is a monovalent hydrocarbon group having 1 to 8 carbon atoms, such as methyl group, ethyl group, propyl group, butyl group, pentyl group, hexyl group, heptyl group, octyl group, cyclohexyl group, phenyl group, vinyl group or aryl group. Among them, methyl group is particularly preferred.

As the silazane compound represented by the general formula $R^3{}_3SiNHSiR^3$, there can be used, for example, hexamethyldisilazane, hexaethyldisilazane, hexapropyldisilazane, hexabutyldisilazane, hexapentyldisilazane, hexahexyldisilazane, hexacyclohexyldisilazane, hexaphenyldisilazane and divinyltetramethyldisilazane. In particular, hexamethyldisilazane is preferred from its hydrophobic property after reformed and the easiness of its removal.

The hydrophobic property-imparting treatment may be conducted according to a known method of improving the surfaces of a fine silica powder without any particular limitation. According to this method, a silazane compound is brought into contact with an alkoxysilane in the presence of water in a gaseous phase, in a liquid phase or in a solid phase at 0 to 40° C. and is, thereafter, heated at 50 to 400° C., so that an excess of silazane compound is removed.

The amount of water is decreased to be not larger than 2.0% by weight upon heating by using a burner or the like, and fine silicon-containing oxide particles are thus obtained. If the amount of water is decreased upon heating after the fine silicon-containing oxide particles have been externally added to the toner particles, the toner particles are melted by heating. Therefore the amount of water is decreased upon heating prior to externally adding the fine silicon-containing oxide particles.

The fine silicon-containing oxide particles can be produced not only by the above sol-gel method but also by a gaseous phase method (method of production by burning a silicon compound or metal silicon in an oxyhydrogen flame).

[Fine Particles (Very Small Particles), Having an Average Primary Particle Size Smaller than that of the Fine Silicon-Containing Oxide Particles]

In addition to the above particles, the toner of the invention desirably contains at least one or more kinds of fine particles having an average primary particle size smaller than that of the fine silicon-containing oxide particles (hereinafter often called "very small particles"). By using the fine silicon-containing oxide particles and very small particles in combination, fluidity of the toner can be ensured, specific charge of the toner in the developer can be quickly raised, and the printed image acquires stable quality.

As the very small particles, there can be used a fine silica powder, a fine titanium oxide powder and a fine alumina powder, and they may be used each alone or two or more of them may be used in combination.

It is preferable that the very small particles have an average primary particle size of 7 to 16 nm by taking into consideration the amount of electric charge necessary for the toner, effect on the abrasion of the photoreceptor due to the addition thereof and environmental properties of the toner.

The average primary particle size can be measured by using a particle size distribution-measuring apparatus that utilizes dynamic scattering of light, such as DLS-80 (trade name, manufactured by Otsuka Electronics Co., Ltd.) and Coulter N4 (trade name, manufactured by Coulter Electronics Ltd.). However, since it is difficult to dissociate the secondary aggregation of particles that have been treated to be hydrophobic, it is preferable to directly find the average primary particle size by analyzing the image photographed by using a scanning electron microscope (SEM) or a transmission electron microscope (TEM).

[Toner]

The toner particles and the fine silicon-containing oxide particles are mixed together, so that the fine silicon-containing oxide particles are externally added to the toner particles to thereby obtain the toner. Here, the above very small particles may also be mixed thereto.

The mixing can be done by any method by using, for example, a V-blender, Henschel mixer, a ribbon blender or a mixing and grinding machine.

It is preferable that the fine silicon-containing oxide particles are added in an amount of not less than 0.5 part by weight but not more than 3.0 parts by weight based on 100 parts by weight of the toner particles by taking into consideration the amount of electric charge necessary for the toner, effect on the abrasion of the photoreceptor due to the addition of the fine silicon-containing oxide particles and environmental properties of the toner. Cleanness is ensured on the photoreceptor drum and on the transfer belt, and the amount of specific charge of the toner is prevented from decreasing in the endurance printing test offering excellent charge stability. In particular, since the amount of the fine silicon-containing oxide particles decreases on the side of small particle sizes, fixing property can be ensured.

If the amount of addition thereof is less than 0.5 part by weight, cleanness cannot be ensured. If the amount of addition thereof exceeds 3.0 parts by weight, the fine silicon-containing oxide particles are made present in increased amounts between the toner and the carrier, whereby defective contact occurs, the electric charge becomes poor, the amount of specific charge of the toner decreases, and the toner scatters in the apparatus.

It is preferable that the very small particles are added in an amount of not more than 2 parts by weight based on 100 parts by weight of the toner particles by taking into consideration the amount of electric charge necessary for the toner, effect on the abrasion of the photoreceptor due to the addition thereof and environmental properties of the toner.

It is preferable that the toner of the invention has a volume average particle size of 4 to 8 μm. Cleanness is ensured on the photoreceptor drum and on the transfer belt, and the amount of specific charge of the toner is prevented from decreasing in the endurance printing test offering excellent charge stability. Cleanness cannot be ensured if the toner has a volume average particle size which is smaller than 4 μm or larger than 8 μm.

Here, the volume average particle size is measured by using, for example, a particle size distribution-measuring apparatus (trade name: Multisizer 2, manufactured by Beckman Coulter Inc.) and is calculated from a volume particle size distribution of the sample particles.

The thus obtained toner of the invention can be readily used as a one-component developer or can be used as a two-component developer upon being mixed with the carrier.

As the carrier, magnetic particles can be used. Concrete examples of the magnetic particles include metals such as iron, ferrite and magnetite, as well as alloys of these metals and such a metal as aluminum or lead. Among them, ferrite is preferred.

There can be, further, used a coated carrier obtained by coating magnetic particles with a resin or a resin dispersion carrier obtained by dispersing magnetic particles in a resin. As the resin for coating the magnetic particles, there can be used, for example, olefin resin, styrene resin, styrene/acrylic resin, silicone resin, ester resin and fluorine-contained polymer resin though there is no particular limitation. As the resin used for the resin dispersion carrier, there can be used, for example, styrene-acrylic resin, polyester resin, fluorine-contained resin and phenol resin though there is no particular limitation.

It is preferable that the carrier has a spherical shape or a flat shape. Though there is no particular limitation, it is preferable that the carrier has a volume average particle size of, preferably, not smaller than 10 μm but not larger than 100 μm and, more preferably, not smaller than 20 μm but not larger than 50 μm by taking high image quality into consideration. Moreover, it is preferable that the carrier resistivity is, preferably, not smaller than $10^8\Omega\cdot$cm and, more preferably, not smaller than $10^{12}\Omega\cdot$cm. The resistivity of the carrier is found by introducing the carrier into a container having a sectional area of 0.50 $cm^2$, tapping the container, exerting a load of 1 $kg/cm^2$ on the particles packed in the container, applying a voltage across the load and the bottom surface electrode so as to establish an electric field of 1000 V/cm, and reading arm electric current that flows at this moment. If the resistivity is low, an electric charge is poured into the carrier when a bias voltage is applied to a developing sleeve, and the carrier particles tend to adhere on the photoreceptor. Besides, the bias voltage easily breaks down.

The intensity of magnetization (maximum magnetization) of the carrier is, preferably, not smaller than 10 emu/g but not larger than 60 emu/g and, more preferably, not smaller than 15 emu/g but not larger than 40 emu/g. The intensity of magnetization may vary depending upon the magnetic flux density of the developing roller. Under the conditions of a magnetic flux density of a general developing roller, however, if the intensity of magnetization is smaller than 10 emu/g, no magnetic binding force works and the carrier tends to scatter. Further, if the intensity of magnetization exceeds 60 emu/g, it becomes difficult to maintain the state of not contacting to the image carrier in the non-contact developing in which the ear of the carrier becomes too high. In the contact developing, sweeping stripes may easily appear on the toner image.

There is no particular limitation on the ratio of using the toner and the carrier in the two-component developer, and the ratio can be suitably selected depending upon the toner and the carrier. In the case of the resin-coated carrier (density of 5 to 8 $g/cm^2$), for example, the toner may be used in an amount of 2 to 30% by weight and, preferably, 2 to 20% by weight based on the whole amount of the developer. In the two-component developer, further, the ratio of coating carrier with the toner is desirably not less than 40 to 80%.

FIG. 1 is a sectional view illustrating the constitution of an image forming apparatus 1 according to an embodiment of the invention. The image forming apparatus 1 is a multi-function peripheral having a copier function, a printer function and a facsimile function in combination, and forms a full-color or monochromatic image on a recording medium depending upon the transmitted image information. That is, the image forming apparatus has three kinds of printing modes, i.e., copier mode (reproduction mode), printer mode and facsimile mode and in which a control unit (not shown) selects a printing mode depending upon the reception of an input through an operation portion (not shown), or a print job from a personal computer, a portable terminal device, an information storage medium or external equipment using a memory. The image forming apparatus 1 includes a toner image forming section 2, a transfer section 3, a fixing section 4, a recording medium feeding section 5 and a discharge section 6. The members constituting the toner image forming section 2 and some of the members included in the transfer section 3 are each constituted in a number of four to cope with image information of such colors as black (b), cyan (c), magenta (m) and yellow (y) included in the color image information. Here, the members each provided in a number of four to meet the colors take alphabets representing colors at the ends of the reference numerals so as to be distinguished, and take reference numerals only when they are to be collectively referred to.

The toner image forming section 2 includes a photoreceptor drum 1, a charging section, 12, an exposure unit 13, a developing device 14 and a cleaning unit 15. The charging section 12, developing device 14 and cleaning unit 15 are arranged in this order in a direction in which the photoreceptor drum 11 rotates. The charging section 12 is arranged under the developing device 14 and the cleaning unit 15 in a vertical direction.

The photoreceptor drum 11 is supported by a drive portion (not shown) so as to be driven to rotate about the axis thereof, and includes a conductive substrate and a photosensitive layer formed on the surface of the conductive substrate, that are not shown. The conductive substrate can assume various forms, such as a cylinder, a column or a thin sheet. Among them, the cylinder is preferred. The conductive substrate is formed by using a conductive material. The conductive material may be the one that is usually used in this field of art, such as a metal like aluminum, copper, brass, zinc, nickel, stainless steel, chromium, molybdenum, vanadium, indium, titanium, gold or platinum, an alloy of two or more of the above-mentioned metals, a conductive film obtained by forming a conductive layer of one or two or more selected from aluminum, aluminum alloy, tin oxide, gold and indium oxide on a film-like base material such as synthetic resin film, metal film or paper, or a resin composition containing conductive particles and/or a conductive polymer. As the film-like base material used for the conductive film, a synthetic resin film is preferred and a polyester film is particularly preferred. The conductive layer is formed on the conductive film by, preferably, vacuum evaporation or by being applied thereon.

The photosensitive layer is formed by, for example, laminating a charge generating layer containing a charge generating substance and a charge transporting layer containing a charge transporting substance. Here, an undercoat layer is desirably provided between the conductive substrate and the charge generating layer or the charge transporting layer. The undercoat layer covers scars and asperities on the surface of the conductive substrate, and offers such advantages as smoothing the surface of the photosensitive layer, preventing the charging property of the photosensitive layer from deteriorating after the repetitive use, and improving charging characteristics of the photosensitive layer in a low-temperature and/or a low-humidity environment. Further, a photoreceptor surface protection layer may be provided as the uppermost layer to obtain a layered photoreceptor of a three-layer structure having increased durability The charge generating layer contains, as a chief component, the charge generating substance that generates the electric charge upon being irradiated with light and may, further, contain a known binder resin, a plasticizer and a sensitizer, as required. The charge generating substance may be the one that is usually used in this field, and there can be used perillene pigments such as perilleneimide and anhydrous perylenic acid; polycyclic quinone pigments such as quinacridone and anthraquinone; phthalocyanine pigments such as metal and metal-free phthalocyanines and halogenated metal-free phthalocyanine; and azo pigments having squarium pigment, azulenium pigment, thiapyrylium pigment, carbazole skeleton, styrylstylbene sleketon, triphenylamine skeleton, dibenzothiophene skeleton, oxadiazole skeleton, fluorenone skeleton, bisstylbene skeleton, distyryloxadiazole skeleton or distyrylcarbazole skeleton. Among them, the metal-free phthalocyanine pigment, oxotitanylphthalocyanine pigment, bisazo pigment containing a fluorene ring and/or a fluorenone ring, bisazo pigment comprising an aromatic amine and trisazo pigment, have high charge-generating capability and are suited for obtaining a highly sensitive photosensitive layer. The charge generating substances may be used each alone or two or more of them may be used in combination. Though there is no particular limitation, the charge generating substance can be contained in an amount of, preferably, 5 to 500 parts by weight and, more preferably, 10 to 200 parts by weight based on 100 parts by weight of the binder resin in the charge generating layer.

The binder resin used for the charge generating layer may be the one that is usually used in this field of art, such as melamine resin, epoxy resin, silicone resin, polyurethane, acrylic resin, vinyl chloride/vinyl acetate copolymer resin, polycarbonate, phenoxy resin, polyvinyl butyral, polyarylate, polyamide and polyester. The binder resins may be used each alone or, as required, two or more of them may be used in combination.

The charge generating layer can be formed by preparing a coating solution for charge generating layer by dissolving or dispersing the charge generating substance, binder resin and, as required, plasticizer and sensitizer in suitable amounts in a suitable organic solvent capable of dissolving or dispersing these components, and applying the coating solution for charge generating layer onto the surface of the conductive substrate, followed by drying. Though there is no particular limitation, the thus obtained charge generating layer has a thickness of, preferably, 0.05 to 5 μm and, more preferably, 0.1 to 2.5 μm.

The charge transporting layer laminated on the charge generating layer contains the charge transporting substance capable of receiving and transporting the electric charge generated by the charge generating substance and the binder resin for the charge transporting layer as essential components and, further, contains, as required, a known antioxidizing agent, plasticizer, sensitizer and lubricant. The charge transporting substance may be the one that is usual y used in this field of art, and there can be used electron-donating materials such as poly-N-vinylcarbazole and derivatives thereof, poly-γ-carbazolylethyl glutamate and derivatives thereof, pyrene/formaldehyde condensate and derivatives thereof, polyvinylpyrene, polyvinylphenanthrene, oxazole derivative, oxadiazole derivative, imidazole derivative, 9-(p-diethylaminostyryl)anthracene, 1,1-bis(4-dibenzylaminophenyl)propane, styrylanthracene, styrylpyrazoline, pyrazoline derivative, phenylhydrazones, hydrazone derivative, triphenylamine compound, tetraphenyldiamine compound, triphenylmethane compound, stylbene compound and azine compound having a 3-methyl-2-benzothiazoline ring; and electron-accepting materials, such as fluorenone derivative, dibenzothiophene derivative, indenothiophene derivative, phenanthrenequinone derivative, indenopyridine derivative, thioxanthone derivative, benzo[c]cinnoline derivative, phenadineoxide derivative, tetracyanoethylene, tetracyanoquinodimethane, bromanil, chloranil and benzoquinone. The charge transporting substances may be used each alone or two or more of them may be used in combination. Though there is no particular limitation, the charge transporting substance can be contained in an amount of 10 to 300 parts by weight and, more preferably, 30 to 150 parts by weight based on 100 parts by weight of the binder resin in the charge transporting layer.

The binder resin used for the charge transporting layer may be the one that is usually used in this field of art and that is capable of homogeneously dispersing the charge transporting substance therein. There can be used, for example, polycarbonate, polyarylate, polyvinyl butyral, polyamide, polyester, polyketone, epoxy resin, polyurethane, polyvinyl ketone, polystyrene, polyacrylamide, phenol resin, phenoxy resin, polysulfone resin or copolymer resin thereof. Among them, it is preferable to use polycarbonate containing bisphenol Z as a monomer component (hereinafter referred to as bisphenol Z-type polycarbonate) or a mixture of the bisphenol Z-type polycarbonate and other polycarbonates from the standpoint of film-forming property, wear resistance of the obtained charge transporting layer and electric properties. The binder resins can be used each alone or two or more of them may be used in combination.

It is preferable that the charge transporting layer contains an antioxidizing agent together with the charge transporting substance and the binder resin for the charge transporting layer. The antioxidizing agent may be the one usually used in this field of art, such as vitamin E, hydroquinone, hindered amine, hindered phenol, paraphenylenediamine, arylalkane and derivatives thereof, organosulfur compound and organophosphor compound. The antioxidizing agents may be used each alone or two or more of them may be used in combination. Though there is no particular limitation, the content of the antioxidizing agent is 0.01 to 10% by weight and, preferably, 0.05 to 5% by weight based on the total amount of the components constituting the charge transporting layer.

The charge transporting layer can be formed by preparing a coating solution for charge transporting layer by dissolving or dispersing the charge transporting substance, binder resin and, as required, antioxidizing agent, plasticizer and sensitizer in suitable amounts in a suitable organic solvent capable of dissolving or dispersing these components, and applying the coating solution for charge transporting layer onto the surface of the charge generating layer, followed by drying. Though there is no particular limitation, the thus obtained charge transporting layer has a thickness of, preferably, 10 to 50 μm and, more preferably, 15 to 40 μm. Here, the photosensitive layer can also be formed by making the charge generating substance and the charge transporting substance present in one layer. In this case, the kinds and contents of the charge generating substance and of the charge transporting material, the binder resin and other additives may be the same as those of when the charge generating layer and the charge transporting layer are separately formed.

This embodiment employs the photoreceptor drum that forms the organic photosensitive layer by using the charge generating substance and the charge transporting substance. It is, however, also allowable to employ the photoreceptor drum that forms the inorganic photosensitive layer by using silicon and the like.

The charging section 12 faces the photoreceptor drum 11, is arranged along the longitudinal direction of the photoreceptor drum 11 maintaining a gap from the surface of the photoreceptor drum 11, and electrically charges the surface of the photoreceptor drum 11 into a predetermined polarity and potential. As the charging section 12, there can be used a charging brush-type charger, a charger-type charger, a pin array charger or an ion generator. In this embodiment, the charging section 12 is provided being separated away from the surface of the photoreceptor drum 11, to which only, however, the invention is not limited. For example, a charging roller may be used as the charging section 12 and may be so arranged as to come in pressure-contact with the photoreceptor drum. Or, there may be used a charger of the contact charging type, such as a charging brush or a magnetic brush.

The exposure unit 13 is so arranged that light corresponding to the respective pieces of color information from the exposure unit 13 passes through between the charging section 12 and the developing device 14, and falls on the surface of the photoreceptor drum 11. The exposure unit 13 converts the image information into light corresponding to the respective pieces of color information b, c, m and y in the unit, and exposes the surface of the photoreceptor drum 11 charged to uniform potential by the charging means 12 to light corresponding to the respective pieces of color information to form electrostatic latent image on the surface. As the exposure unit 13, there can be used a laser scanning unit having a laser irradiation portion and a plurality of reflectors. There can be, further, used a unit which is suitably combined with an LED (light emitting diode) array, a liquid crystal shutter and a source of light.

Figure 2:
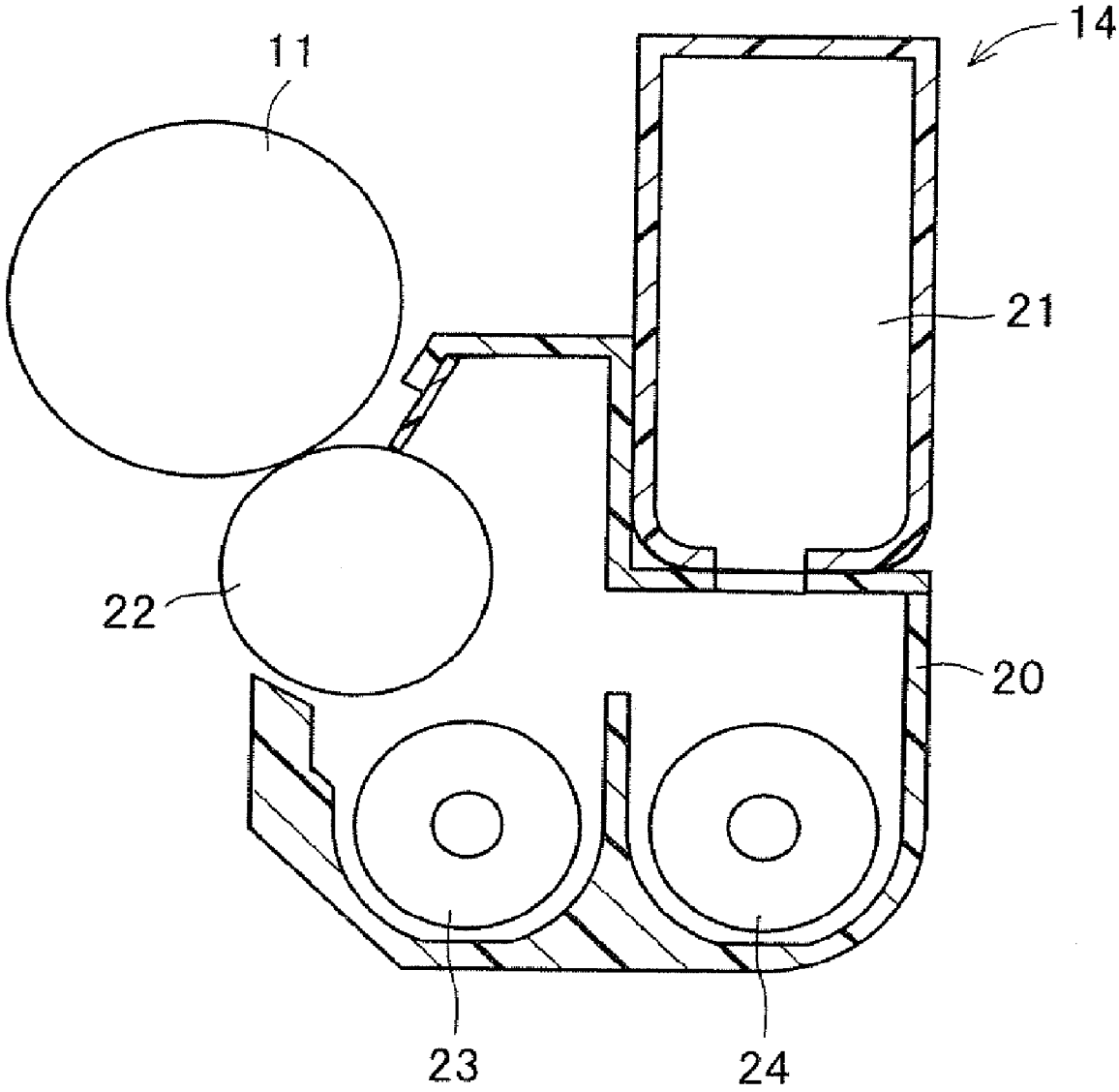
FIG. 2 is a view schematically illustrating the constitution of a developing device of the invention.

FIG. 2 is a view showing the constitution of the developing device 14 of the invention. The developing device 14 includes a developing tank 20 and a toner hopper 21. The developing tank 20 is a container member which is so arranged as to face the surface of the photoreceptor drum 11, feeds the toner to the electrostatic latent image formed on the surface of the photoreceptor drum 11 to develop it to thereby form a toner image which is a visible image. The developing tank 20 contains the toner in the inner space thereof, and contains roller members such as a developing roller 22, a feed roller 23 and a stirrer roller 24, or screw members, and rotatably supports them. An opening portion is formed in the side surface of the developing tank 20 facing the photoreceptor drum 11, and the developing roller 22 is rotatably provided at a position where it faces the photoreceptor drum 11 via the opening portion. The developing roller 22 is a roller member that feeds the toner to the electrostatic latent image on the surface of the photoreceptor drum 11 at a position where the developing roller 22 is in pressure-contact with, or is the closest to, the photoreceptor drum 11. In feeding the toner, a potential of a polarity opposite to the charged potential of the toner is applied to the surface of the developing roller 22 as the developing bias voltage. Therefore, the toner on the surface of the developing roller 22 is smoothly fed to the electrostatic latent image. By varying the developing bias voltage value, further, the amount of toner (toner attachment amount) fed to the electrostatic latent image can be controlled. The feed roller 23 is a roller member rotatably provided facing the developing roller 22, and feeds the toner to the periphery of the developing roller 22. The stirrer roller 24 is a roller member rotatably provided facing the feed roller 23, and feeds, to the periphery of the feed roller 23, the toner that is newly fed into the developing tank 20 from the toner hopper 21. The toner hopper 21 is so provided that a toner replenishing port (not shown) provided at a lower portion thereof in the vertical direction is communicated with a toner receiving port (not shown) formed in the upper part of the developing tank 20 in the vertical direction, and works to replenish the toner depending upon the consumption of toner in the developing tank 20. Instead of using the toner hopper 21, it is also allowable to directly replenish the toner from the toner cartridges of various colors.

After the toner image is transferred onto the recording medium, the cleaning unit 15 removes the toner remaining on the surface of the photoreceptor drum 11, and cleans the surface of the photoreceptor drum 11. As the cleaning unit 15, a plate-like member is used, such as a cleaning blade. In the image forming apparatus of the invention, an organic photoreceptor drum is chiefly used as the photoreceptor drum 11. The surface of the organic photoreceptor drum chiefly comprises a resin component and undergoes the deterioration due to the chemical action of ozone generated by the corona discharge of the charging device. Here, however, the deteriorated surface is abraded being rubbed by the cleaning unit 15, and is reliably removed though gradually. Therefore, the problem of deterioration of the surface due to ozone is virtually eliminated, and the potential due to the charging operation can be stably maintained over extended periods of time. The cleaning unit 15 is provided in this embodiment. Without being limited thereto, however, the cleaning unit 15 may not be provided.

In the toner image forming section 2, the surface of the photoreceptor drum 11 which is being uniformly charged by the charging section 12 is irradiated with signal beams corresponding to image information from the exposure unit 13 to form an electrostatic latent image, the toner is fed thereto from the developing device 14 to form a toner image which is, then, transferred onto an intermediate transfer belt 25. Thereafter, the toner remaining on the surface of the photoreceptor drum 11 is removed by the cleaning unit 15. The above-mentioned series of toner image forming operations is repetitively executed.

The transfer section 3 is arranged over the photoreceptor drum 11, and includes an intermediate transfer belt 25, a drive roller 26, a driven roller 27, intermediate transfer rollers 28 (*b, c, m, y*), a transfer belt cleaning unit 29, and a transfer roller 30. The intermediate transfer belt 25 is an endless belt member stretched between the driver roller 126 and the driven roller 27, and forms a loop~like moving path, and rotates in the direction of an arrow B. While the intermediate transfer belt 25 passes by the photoreceptor drum 11 in contact with the photoreceptor drum 11, the intermediate transfer roller 28 arranged facing the photoreceptor drum 11 via the intermediate transfer belt 25 applies a transfer bias voltage of a polarity opposite to the polarity of charge of the toner on the surface of the photoreceptor drum 11, and the toner image formed on the surface of the photoreceptor drum 11 is transferred onto the intermediate transfer belt 25. In the case of the full-color image, toner images of various colors formed by the photoreceptor drums 11 are successively transferred and overlaid onto the intermediate transfer belt 25 one upon the other, and the full-color toner image is formed. The drive roller 26 is rotatably provided so as to rotate about the axis thereof being driven by a drive portion (not shown) and due to its rotation, the intermediate transfer belt 25 is driven in the direction of the arrow B. The driven roller 27 is rotatably provided so as to rotate following the rotation of the drive roller 26, and imparts a predetermined tension to the intermediate transfer belt 25 to prevent the intermediate transfer belt 25 from being slackened. The intermediate transfer roller 28 is rotatably provided to come into pressure-contact with the photoreceptor drum 11 via the intermediate transfer belt 25, and is driven by a drive portion (not shown) so as to rotate about the axis thereof. The intermediate transfer roller 28 is connected to a power source (not shown) for applying the transfer bias as described above, and has a function for transferring the toner image on the surface of the photoreceptor drum 11 onto the intermediate transfer belt 25.

The transfer belt cleaning unit 29 faces the driven roller 27 via the intermediate transfer belt 25, and comes in contact with the outer peripheral surface of the intermediate transfer belt 25. The toner that adheres to the intermediate transfer belt 25 due to the contact with the photoreceptor drum 11 becomes a cause of contaminating the back surface of the recording medium. Therefore, the transfer belt cleaning unit 29 recovers the toner by removing it from the surface of the intermediate transfer belt 25. The transfer roller 30 is rotatably provided to come into pressure-contact with the drive roller 26 via the intermediate transfer belt 25, and is driven by a drive portion (not shown) so as to rotate about the axis thereof. At the pressure-contact portion (transfer nip portion) between the transfer roller 30 and the drive roller 26, the toner image conveyed while being borne on the intermediate transfer belt 25 is transferred onto the recording medium fed from a recording medium feeding section 5 that will be described later. The recording medium bearing the toner image thereon is fed to the fixing section 4. In the transfer section 3, the toner image is transferred from the photoreceptor drum 11 onto the intermediate transfer belt 25 at the pressure-contact portion between the photoreceptor drum 11 and the intermediate transfer roller 28, conveyed to the transfer nip portion as the intermediate transfer belt 25 is driven in the direction of the arrow B, and is transferred onto the recording medium.

The fixing section 4 is provided downstream of the transfer section 3 in the direction in which the recording medium is conveyed, and includes a fixing roller 31 and a pressure roller 32. The fixing roller 31 is provided so as to be rotated by being driven by a drive portion (not shown), and heats and melts the toner that constitutes the unfixed toner image borne on the recording medium to thereby fix it to the recording medium. The fixing roller 31 contains therein a heating portion (not shown). The heating portion so heats the fixing roller 31 that the surface of the fixing roller 31 assumes a predetermined temperature (heating temperature). As the heating portion, there can be used, for example, a heater or a halogen lamp. The heating portion is controlled by a fixing condition control portion. A temperature detector is provided, near the surface of the fixing roller 31 to detect the surface temperature of the fixing roller 31. The result detected by the temperature detector is written into a memory portion of a control unit described later. The pressure roller 32 is provided to be in pressure-contact with the fixing roller 31 and is driven by the rotation of the fixing roller 31. At the time when the toner is fused and is fixed to the recording medium by the fixing roller 31, the pressure roller 32 presses the toner and the recording medium to assist, the fixing of the toner image on the recording medium. The pressure-contact portion between the fixing roller 31 and the pressure roller 32 is a fix nip portion. In the fixing section 4, the recording medium to which the toner image is transferred in the transfer section 3 is held by the fixing roller 31 and the pressure roller 32, and passes through the fix nip portion whereby the toner image is pressed onto the recording medium under a heated condition and the toner image is fixed onto the recording medium to form the image.

The recording medium feeding section 5 includes an automatic paper feed tray 35, a pickup roller 36, conveying rollers 37, registration rollers 38, a manual paper feed tray 39. The automatic paper feed tray 35 is a container-like member disposed below the image forming apparatus in the vertical direction and stores the recording mediums. Examples of he recording mediums include plain paper, color copy paper, sheets for overhead projector use, and postcards. The pickup roller 36 takes out recording mediums stored in the automatic paper feed tray 35 one by one and feeds each recording medium to a paper conveyance path S1. The conveying rollers 37 are a pair of roller members disposed so as to be in pressure-contact with each other and convey the recording medium to the registration rollers 38. The registration rollers 38 are a pair of roller members disposed so as to be in pressure-contact with each other and feed the recording medium fed from the conveying rollers 37 to the transfer nip portion in synchronization with the conveying of toner images borne on the intermediate transfer belt 25 to the transfer nip portion. The manual paper feed tray 39 is a device storing recording mediums which are different from the recording mediums stored in the automatic paper feed tray 35 and may have any size and which are to be taken into the image forming apparatus. The recording medium taken in from the manual paper feed tray 39 is made to pass through a paper conveyance path 52 by means of the conveying rollers 37 and fed to the registration rollers 38. The recording medium feeding section 5 feeds the recording mediums fed one by one from the automatic paper feed tray 35 or the manual paper feed tray 39 to the transfer nip portion in synchronization with the conveying of toner images borne on the intermediate transfer belt 25 to the transfer nip portion.

The discharge section 6 includes the conveying roller 37, discharging rollers 40 and a catch tray 41. The conveying rollers 37 are disposed on a side of downstream in the paper conveying direction from the fixing nip portion, and convey the recording medium to which the images are fixed by the fixing section 4, to the discharging rollers 40. The discharging rollers 40 discharge the recording medium to which the images are fixed, to the catch tray 41 disposed at the upper surface of the image forming apparatus in the vertical direction. The catch tray 41 stores recording mediums to which the images are fixed.

The image forming apparatus 1 includes a control unit (not shown). The control unit is disposed, for example, in an upper portion in the inner space of the image forming apparatus and includes a memory portion, a computing portion, and a control portion. The memory portion of the control unit is inputted, for example, with various setting values via an operation panel (not shown) disposed to the upper surface of the image forming apparatus, detection result from sensors (not shown), etc. disposed at each portion in the image forming apparatus, and image information from external apparatuses. Further, programs for executing operations of various functional elements are written in the memory portion. The various functional elements are, for example, a recording medium judging section, an attachment amount control section, the fixing condition control section, etc. As the memory portion, those customarily used in this field can be used and examples thereof include read only memory (ROM), random access memory (RAM), and hard disk drive (HDD). As the external apparatuses, electric and electronic apparatuses capable of forming or acquiring image information and capable of being electrically connected with the image forming apparatus can be used, and examples thereof include a computer, a digital camera, a television set, a video recorder, a DVD (Digital versatile Disc) recorder, HDDVD (High-Definition Digital Versatile Disc), a blu-ray disk recorder, a facsimile unit, and a portable terminal apparatus. The computing portion Lakes out various data written into the memory portion (image forming instruction, detection result, image formation, etc. and programs for various functional elements to conduct various judgments. The control portion delivers control signals to the relevant apparatus in accordance with the result of judgment of the calculation section to conduct operation control. The control portion and the computing portion include a processing circuit provided by a microcomputer, a microprocessor, etc. provided with a central processing unit (CPU). The control unit includes a main power source together with the processing circuit described above, and the power source supplies power not only to the control unit but also to each of the devices in the inside of the image forming apparatus.

By using the toner, two-component developer, developing device and image forming apparatus of the invention, a highly fine image having high resolution and high quality is formed without a decrease in the quality that stems from defective fluidity.

EXAMPLES

The invention will now be concretely described by way of Examples and Comparative Examples to which only, however, the invention is in no way limited unless the gist thereof is departed. In Examples, a magenta toner is used as the toner. The magenta toner contains the C.I. Pigment Red 57:1 pertaining to magenta as a coloring agent. In place of this coloring agent, however, it is also allowable to contain various coloring agents described above to similarly put the invention into practice.

In the following description, "parts" and "%" are all "parts by weight" and "% by weight" unless stated otherwise. In Examples and Comparative Examples, properties of the toner and the like were measured as described below.

[Volume Average Particle Size and Coefficient of Variation (CV Value)]

A sample for measurement was prepared by adding 20 mg of the sample and 1 ml of sodium alkyl ether sulfate to 50 ml of an electrolyte (trade name: ISOTON-II, manufactured by Beckman Coulter Inc.), and dispersing the mixture by using an ultrasonic wave dispersion device (trade name: UH-50, manufactured by SMT Co., Ltd.) at an ultrasonic wave frequency of 20 kHz for 3 minutes. By using a particle size distribution-measuring device (trade name: Multisizer 3, manufactured by Beckman Coulter Inc.), the sample for measurement was measured under the conditions Of an aperture diameter of 100 μm and number of particles to be measured of 50,000 counts. A volume average particle size was found from the volume particle size distribution of the sample particles. Further, a coefficient of variation of the toner was calculated from the following formula (1) based on the volume average particle size and the standard deviation thereof.

$$\text{Coefficient of variation} = \text{Standard deviation}/\text{volume average particle size} \quad (1)$$

[Glass Transition Temperature (Tg) of Binder Resin]

By using a differential scanning calorimeter (trade name: DSC 220, manufactured by Seiko instruments & Electronics Ltd.), 1 g of the sample was heated at a rate of 10° C. a minute to measure a DSC curve thereof in compliance with the Japanese Industrial Standards (JIS) K 7121-1987. The glass transition temperature (Tg) was found from a temperature at a point where a straight line drawn by extending a base line on the high temperature side of the endothermic peak corresponding to the glass transition of the obtained DSC curve toward the low temperature side, intersected a tangential line drawn at a point where the gradient became a maximum with respect to a curve from a rising portion of peak to a vertex.

[Softening Temperature (Tm) of Binder Resin]

The apparatus for evaluating the flow characteristics (trade name: Flow Tester CFT-100C manufactured by Shimadzu Corporation) was so set that 1 g of a sample was extruded from a die (nozzle, port diameter of 1 mm, length of 1 mm) under a load of 10 kgf/cm$^2$ ($9.8\times10^5$ Pa). The sample was heated at a heating rate of 6° C. a minute, and the temperature was found at a moment when half the amount of the sample has flown from the die, and was regarded to be a softening temperature.

[Melting Point of Release Agent]

By using a differential scanning calorimeter (trade name: DSC 220, manufactured by Seiko Instruments & Electronics Ltd.), 1 g of the sample was heated at a rate of 10° C. a minute from a temperature of 20° C. up to 200° C. and was, quickly cooled from 200° C. down to 20° C. This operation was repeated twice to measure a DSC curve. The temperature at a vertex of the endothermic peak corresponding to the melt in of the DSC curve measured in the second operation was regarded to be the melting point of the release agent.

[Average Primary Particle Size of Fine Silicon-Containing Oxide Particles]

An image enlarged to 50,000 times by using a scanning electron microscope (trade name: S-4300SE/N, manufactured by Hitachi High-Technologies Corporation) was photographed covering 100 particles while varying the visual field of the scanning electron microscope, and the particle sizes of the primary particles were measured by analyzing the image. The average particle size was calculated from the measured values.

[Specific Surface Area of Fine Silicon-Containing Oxide Particles]

The BET specific surface area was found by the BET three-point method by finding a gradient A from the amount of nitrogen adsorption for three relative pressure points and finding the specific surface area from the BET formula. Measured by using a specific area/fine pore distribution measuring apparatus (trade name: NOVAe 4200e, manufactured by Yuasa-Ionics Co., Ltd.)

[Amount of Water in Fine Silicon-Containing Oxide Particles]

Measured by using a Karl-Fischer moisture measuring system (trade name: CA-100, manufactured by Mitsubishi Chemical Corporation). The heating temperature was set at 105° C.

(Preliminary Examination)

The fine silicon-containing oxide particles were prepared relying upon the dry method (Examples A to C) and upon the wet method (sol-gel method or sedimentation method). The fine silicon-containing oxide particles which did not lose the weight on heating (sol-gel method in Comparative Example A, sedimentation method in Comparative Example B) were measured for their amounts of water.

Table 1 shows the average primary particle sizes of the fine silicon-containing oxide particles of Examples A to C and Comparative Examples A and B and the measured amounts of water.

TABLE 1

| | Particle size (nm) | Amount of water (g) | Measured amount (g) | Water content (%) | Heating temperature (° C.) |
|---|---|---|---|---|---|
| Example A | 125 | $3.97 \times 10^{-4}$ | 0.5883 | 0.067 | 105 |
| Example B | 90 | $1.37 \times 10^{-4}$ | 0.4522 | 0.030 | 105 |
| Example C | 40 | $5.44 \times 10^{-4}$ | 0.5368 | 0.101 | 105 |
| Comparative Example A | 120 | $2.49 \times 10^{-2}$ | 0.3174 | 7.857 | 105 |
| Comparative Example B | 110 | $8.71 \times 10^{-3}$ | 0.1777 | 4.901 | 105 |

The particles prepared by the dry method (Examples A to C) possessed low water contents irrespective of their average primary particle sites. The particles prepared by the wet method (sol-gel method or sedimentation method) and did not lose the weight on heating (Comparative Examples A and B) possessed the water contents of 4 to 8%. If the weight was decreased on heating (dry method), even those particles having an average primary particle size of about 100 nm (Examples A and B) possessed the water content that has decreased down to not larger than 0.1%.

For the fine silicon-containing oxide particles of the invention having an average primary particle size of not smaller than 70 nm but not larger than 150 nm prepared by the wet method (sol-gel method or sedimentation method), therefore, it was learned that the water content (amount of water) does not become smaller than 2.0% unless their weight is decreased on heating.

(Preparation of Toner Particles a)

83 Parts of a polyester (binder resin, trade name: "TOFTONE" TTR-S, manufactured by Kao Corporation, glass transition temperature (Tg) of 60° C., softening temperature (Tm) of 100° C.), 12 parts of a masterbatch (containing 40% of C.I. Pigment Red 57:1), 3 parts of carnauba wax (release agent, trade name: REFINED CARNAUBA WAX, manufactured by S.Kato & Co., melting point, 83° C.), and 2 parts of a metal salt of alkylsalicylic acid (electric charge controller, trade name: BONTRON E-84, manufactured by Orient Chemical Industries, Ltd.) were mixed together in the Henschel mixer for 10 minutes, and were melt-kneaded in a biaxial extrusion kneader (trade name: PCM65, manufactured by Ikegai, Ltd.) The melt-kneaded product was coarsely pulverized by using a cutting mill (trade name: VM-16, manufactured by Orient Kabushiki Kaisha), and was finely pulverized by using a counter-jet mill. Thereafter, excessively pulverized toner was classified and removed by using a rotary classifier to obtain toner particles a having a volume average particle size of 6.0 μm.

(Preparation of Toner Particles b)

Toner particles b having a volume average particle size of 5.5 μm ere obtained in the same manner as that of preparing the toner particles 1 but changing the classifying conditions (Preparation of Toner Particles c)

Toner particles c having a volume average particle size of 6.7 μm were obtained in the same manner as that of preparing the toner particles 1 but changing the classifying conditions.

(Preparation of Fine Silicon-Containing Oxide Particles A)

Prepared by the sol-gel method. A tetramethoxysilane was hydrolyzed in ethanol with nitric acid followed by the condensation reaction to obtain a silica sol suspension. After the solvent was removed therefrom, particles (containing water in an amount of 3 to 15%) were obtained by drying and spheroidizing, and were heated at 1000° C. to decrease the weight until the amount of water became 2.0%. The particles were, thereafter, treated with a silane coupling agent to be hydrophobic. There were obtained fine silicon-containing oxide particles A having an average primary particle size of 70 nm (specific surface area: 45 $m^2/g$) and containing water in an amount of 2.0%.

(Preparation of Fine Silicon-Containing Oxide Particles B)

Fine silicon-containing oxide particles B having an average primary particle size of 100 nm (specific surface area: 40 $m^2/g$) and containing water in an amount of 0.5 were prepared in the same manner as that for obtaining the fine silicon-containing oxide particles A but changing the spheroidizing condition and effecting the heating at 1000° C. to decrease the weight until the amount of water was 0.5%.

(Preparation of Fine Silicon-Containing Oxide Particles C)

Fine silicon-containing oxide particles C having an average primary particle size of 70 nm (specific surface area: 45 $m^2/g$) and containing water in an amount of 0.5% were prepared in the same manner as that for obtaining the fine silicon-containing oxide particles B but changing the spheroidizing condition.

(Preparation of Fine Silicon-Containing Oxide Particles D)

Fine silicon-containing oxide particles D having an average primary particle size of 100 nm (specific surface area: 40 $m^2/g$) and containing water in an amount of 1.0% were prepared in the same manner as that for obtaining the fine silicon-containing oxide particles B but effecting the heating at 1000° C. to decrease the weight until the amount of water was 1.0%.

(Preparation of Fine Silicon-Containing Oxide Particles E)

Fine silicon-containing oxide particles E having an average primary particle size of 120 nm (specific surface area: 25 $m^2/g$; and containing water in an amount of 1.0% were prepared in the same manner as that for obtaining the fine silicon)-containing oxide particles D but changing the spheroidizing condition.

(Preparation of Fine Silicon-Containing Oxide Particles F)

Fine silicon-containing oxide particles F having an average primary particle size of 70 nm (specific surface area: 45 $m^2/g$) and containing water in an amount of 2.0% were prepared in the same manner as that for obtaining the fine silicon-containing oxide particles A but effecting the heating at 1000° C. to decrease the weight until the amount of water was 2.0%.

(Preparation of Fine Silicon-Containing Oxide Particles G)

Fine silicon-containing oxide particles G having an average primary particle size of 100 nm (specific surface area: 40 $m^2/g$) and containing water in an amount of 2.0% were prepared in the same manner as that for obtaining the fine silicon-containing oxide particles B but effecting the heating at 1000° C. to decrease the weight until the amount of water was 2.0%.

(Preparation of Fine Silicon-Containing Oxide Particles H)

Fine silicon-containing oxide particles H having an average primary particle size of 120 nm (specific su face area: 25 $m^2/g$) and containing water in an amount of 2.0% were prepared in the same manner as that for obtaining the fine silicon-containing oxide particles E but effecting the heating at 1000° C. to decrease the weight until the amount of water was 2.0%.

(Preparation of Fine Silicon-Containing Oxide Particles I)

Fine silicon-containing oxide particles I having an average primary particle size of 90 nm (specific surface area: 34 $m^2/g$) and containing water in an amount of 1.0% were prepared in the same manner as that for obtaining the fine silicon-containing oxide particles D but changing the spheroidizing condition.

(Preparation of Fine Silicon-Containing Oxide Particles J)

Fine silicon-containing oxide particles J having an average primary particle size of 90 nm (specific surface area: 34 $m^2/g$) and containing water in an amount of 1.5% were prepared by treating the particles obtained by the dry method with a silane coupling agent to be hydrophobic.

(Preparation of Fine Silicon-Containing Oxide Particles K)

Fine silicon-containing oxide particles K having an average primary particle size of 90 nm (specific surface area: 34 $m^2/g$) and containing water in an amount of 1.5% were prepared in the same manner as that of preparing the fine silicon-containing oxide particles I but heating the particles obtained by the precipitation method (neutralizing an aqueous solution of sodium silicate with sulfuric acid to obtain a silica slurry, followed by filtering, washing with water, drying and, as required, pulverizing to a suitable degree) at 1000° C. to decrease the weight until the amount of water became 1.5%.

(Preparation of Fine Silicon-Containing Oxide Particles L)

Fine silicon-containing oxide particles L having an average primary particle size of 90 nm (specific surface area: 34 $m^2/g$) and containing water in an amount of 1.5% were prepared in the same manner as that of preparing the fine silicon-containing oxide particles I but conducting the treatment for imparting hydrophobic property by using two kinds of hydrophobic property-imparting agents (hexamethyldisilazane and trimethylchlorosilane) and effecting the heating at 1000° C. to decrease the weight until the amount of water was 1.5%.

(Preparation of Fine Silicon-Containing Oxide Particles M)

Fine silicon-containing oxide particles N having an average primary particle size of 110 nm (specific surface area: 25 $m^2/g$) and containing water in an amount of 9% were prepared in the same manner as that of preparing the fine silicon-containing oxide particles A but without effecting the heating to decrease the weight.

(Preparation of Fine Silicon-Containing Oxide Particles N)

Fine silicon-containing oxide particles N having an average primary particle size of 50 nm (specific surface area: 50 $m^2/g$) and containing water in an amount of 2.0% were prepared in the same manner as that of preparing the fine silicon-containing oxide particles A but changing the spheroidizing condition.

(Preparation of Fine Silicon-Containing Oxide Particles P)

Fine silicon-containing oxide particles P having an average primary particle size of 175 nm (specific surface area: 17 $m^2/g$) and containing water in an amount of 2.0% were prepared in the same manner as that of preparing the fine silicon-containing oxide particles A but changing the spheroid zing condition.

Preparation of Toners

Example 1

To 100 parts of the toner particles a having a volume average particle size of 6.0 μm were added 1.0 part of fine silica particles having an average primary particle size of 12 nm (trade name: RX-200, manufactured by Degussa Corporation) and 1.0 part of the fine silicon-containing oxide particles A. The mixture was mixed together in HENSCHELMIXER (trade name: Mitsui FM Mixer, manufactured by Mitsui Mining Co., Ltd.) for 2 minutes to obtain a toner of Example 1.

Example 2

A toner of Example 2 was obtained in the same manner as in Example 1 but adding 1.0 part of the fine silicon-containing oxide particles B.

Example 3

A toner of Example 3 was obtained in the same manner as in Example 1 but adding 1.0 part of the fine silicon-containing oxide particles C.

Example 4

A toner of Example 4 was obtained in the same manner as in Example 1 but adding 1.0 part of the fine silicon-containing containing oxide particles D.

Example 5

A toner of Example 5 was obtained in the same manner as in Example 1 but adding 1.0 part of the fine silicon-containing oxide particles E.

Example 6

A toner of Example 6 was obtained in the same manner as in Example 1 but adding 1.0 part of the fine silicon-containing oxide particles F.

Example 7

A toner of Example 7 was obtained in the same manner as in Example 1 but adding 1.0 part of the fine silicon-containing oxide particles G.

Example 8

A toner of Example 8 was obtained in the same manner as in Example 1 but adding 1.0 part of the fine silicon-containing oxide particles H.

Example 9

A toner of Example 9 was obtained in the same manner as in Example 1 but adding 1.0 part of the fine silicon-containing oxide particles I.

Example 10

A toner of Example 10 was obtained in the same manner as in Example 1 but adding 1.0 part of the fine silicon-containing oxide particles J.

Example 11

A toner of Example 11 was obtained in the same manner as in Example 1 but adding 1.0 part of the fine silicon-containing oxide particles K.

Example 12

A toner of Example 12 was obtained in the same manner as in Example 1 but adding 1.0 part of the fine silicon-containing oxide particles L.

Example 13

A toner of Example 13 was obtained in the same manner as in Example 1 but adding 0.5 part of the fine silicon-containing oxide particles A.

Example 14

A toner of Example 14 was obtained in the same manner as in Example 1 but adding 1.5 parts of the fine silicon-containing oxide particles A.

Example 15

A toner at Example 15 was obtained in the same manner as in Example 1 but adding 2.0 parts of the fine silicon-containing oxide particles A.

Example 16

A toner of Example 16 was obtained in the same manner as in Example 1 but adding 3.0 parts of the fine silicon-containing oxide particles A.

Example 17

A toner of Example 17 was obtained in the same manner as in Example 1 but externally adding 1.0 part of fine titanium oxide particles having an average primary particle size of 14 nm (trade name: NKT-90, manufactured by Degussa Corporation) and, thereafter, adding 1.0 part of the fine silicon-containing oxide particles A.

Example 18

A toner of Example 18 was obtained in the same manner as an Example 1 but using the toner particles b instead of the toner particles a, and adding 1.1 parts of the fine silicon-containing oxide particles A.

Example 19

A toner of Example 19 was obtained in the same manner as in Example 1 but using the toner particles c instead of the toner particles a, and adding 0.9 part of the fine silicon-containing oxide particles A.

Comparative Example 1

A toner of Comparative Example 1 was obtained in the same manner as in Example 1 but adding 1.0 part of the fine silicon-containing oxide particles M.

Comparative Example 2

A toner of Comparative Example 2 was obtained in the same manner as in Example 1 but adding 1.0 part of the fine silicon-containing oxide particles N.

Comparative Example 3

A toner of Comparative Example 3 was obtained in the same manner as no Example 1 but adding 1.0 part of the fine silicon-containing oxide particles P.

Table 2 shows properties of the toners of Examples 1 to 19 and Comparative Examples 1 to 3.

TABLE 2

| | | Fine silicon-containing oxide particles | | | | RX-200 | NKT-90 |
|---|---|---|---|---|---|---|---|
| | Toner particles | Kind | Amount added (part) | Particle size distribution | Hydrophobic treatment | Amount added (part) | Amount added (part) |
| Example 1 | a | A | 1.0 | Monodispersion | Yes | 1.0 | — |
| Example 2 | a | B | 1.0 | Monodispersion | Yes | 1.0 | — |
| Example 3 | a | C | 1.0 | Monodispersion | Yes | 1.0 | — |
| Example 4 | a | D | 1.0 | Monodispersion | Yes | 1.0 | — |
| Example 5 | a | E | 1.0 | Monodispersion | Yes | 1.0 | — |
| Example 6 | a | F | 1.0 | Monodispersion | Yes | 1.0 | — |
| Example 7 | a | G | 1.0 | Monodispersion | Yes | 1.0 | — |
| Example 8 | a | H | 1.0 | Monodispersion | Yes | 1.0 | — |
| Example 9 | a | I | 1.0 | Monodispersion | Yes | 1.0 | — |
| Example 10 | a | J | 1.0 | Monodispersion | Yes | 1.0 | — |
| Example 11 | a | K | 1.0 | Monodispersion | Yes | 1.0 | — |
| Example 12 | a | L | 1.0 | Monodispersion | Yes | 1.0 | — |
| Example 13 | a | A | 0.5 | Monodispersion | Yes | 1.0 | — |
| Example 14 | a | A | 1.5 | Monodispersion | Yes | 1.0 | — |
| Example 15 | a | A | 2.0 | Monodispersion | Yes | 1.0 | — |
| Example 16 | a | A | 3.0 | Monodispersion | Yes | 1.0 | — |
| Example 17 | a | A | 1.0 | Monodispersion | Yes | — | 1.0 |
| Example 18 | b | A | 1.1 | Monodispersion | Yes | 1.0 | — |
| Example 19 | c | A | 0.9 | Monodispersion | Yes | 1.0 | — |
| Comparative Example 1 | a | M | 1.0 | Monodispersion | Yes | 1.0 | — |
| Comparative Example 2 | a | N | 1.0 | Multiple dispersion | Yes | 1.0 | — |
| Comparative Example 3 | a | P | 1.0 | Monodispersion | Yes | 1.0 | — |

(Preparation of Two-Component Developers)

By using a ferrite core carrier having a volume average particle size of 45 μm as the carrier, two-component developers containing toners of Examples 1 to 19 and Comparative Examples 1 to 3 were prepared by mixing the toners of Examples and Comparative Examples to the carrier by using a V-type mixer/kneader (trade name: V-5, manufactured by Tokuju Corporation) and mixing them together for 40 minutes, so that the ratio of coating the carrier with the toner was 60%.

(Evaluation)

The two-component developers containing the toners of Examples 1 to 19 and Comparative Examples 1 to 3 were evaluated as described below.

[White Spots]

The two-component developer was filled in a commercially available copying machine (trade name: MX-3500, manufactured by Sharp Corporation), the amount of adhesion was adjusted to be 0.4 mg/cm$^2$, and an image of 3×5 isolated dots was formed. The image of 3×5 isolated dots is an image in which a plurality of dot portions of a size of longitudinal 3 dots and transverse 3 dots are so formed that the gap among the neighboring dot portions is 5 dots on 600 dpi (dots per inch). The formed image was displayed on a monitor being enlarged into 100 times by using a microscope (trade name: VHX-600, manufactured by Keyence Corporation), and the number of white spots was confirmed among seventy 3×5 isolated dots. The evaluation was made on the following basis.

Excellent: The number of white spots was not more than 3.

Good: The number of white spots was 4 to 6.

Not Bad: The number of white spots was 7 to 10.

Poor: The number of white spots was not less than 11.

[Resolution]

A manuscript forming a half-tone original image of a diameter of 5 mm and an image density of 0.3 describing fine lines of a width of exactly 100 μm was copied by using the above copying machine under a condition capable of reproducing an image density of not less than 0.3 but not more than 0.5, and the copied image was used as a sample for measurement. The sample for measurement was displayed on a monitor being enlarged to 100 times by using a particle analyzer (trade name: Luzex 450, manufactured by Nireco Corporation), and from which the width of fine lines formed on the sample for measurement was measured by using an indicator. The image density was an optical reflection density measured by using a reflection densitometer (trade name: RD-918, manufactured by Macbeth AG). The fine lines were rugged and the width of lines differed depending upon the position of measurement. Therefore, the width of lines were measured at a plurality of measuring positions to find an average value thereof which was regarded to be the width of line on the sample for measurement. The width of line on the sample for measurement was divided by 100 μm which is the width of line on the manuscript, and the obtained value was multiplied by 100 to regard it as a fine line reproduction value. The fine line reproduction value which is close to 100 represents that the fine line is well reproduced and features excellent resolution. The evaluation was made on the following basis.

Excellent: The fine line reproduction value is not smaller than 100 but is smaller than 105.

Good: The fine line reproduction value is not smaller than 105 but is smaller than 115.

Not Bad: The fine line reproduction value is not smaller than 115 but is smaller than 125.

Poor: The fine line reproduction value is not smaller than 125.

[Transfer Efficiency]

The transfer efficiency is the ratio of the toner transferred onto the intermediate transfer belt from the surface of the photoreceptor drum in the primary transfer, and is calculated with the amount of toner present on the photoreceptor drum before the transfer as 100%. The toner present on the photoreceptor drum before the transfer was sucked by using a device for measuring the amount of electric charge (trade name: MODEL 210HS-2A, manufactured by Trek Japan Co., Ltd.), and the transfer efficiency was found by measuring the amount of the sucked toner. The amount of toner transferred onto the intermediate transfer belt was also similarly found. The evaluation was made on the following basis.

Excellent: The transfer efficiency was not smaller than 95%.

Good: The transfer efficiency was not smaller than 90% but was smaller than 95%.

Not Bad: The transfer efficiency was not smaller than 85% but was smaller than 90%.

Poor: The transfer efficiency was smaller than 85%.

[Cleanness]

The pressure of a cleaning blade was set to be 25 gf/cm ($2.45\times10^{-1}$ N/cm) in terms of the initial line pressure, the pressure of the cleaning blade being the pressure with which the cleaning blade of cleaning means of the commercially available copying machine (trade name: MX-3500, manufactured by Sharp Corporation) is brought into contact with the photoreceptor drum. The copying machine was charged with the two-component developers containing the toners obtained in Examples and Comparative Examples, and a character test chart manufactured by Sharp Corporation. was formed on 10,000 pieces of the recording paper in an environment of a normal temperature and a normal humidity, i.e., a temperature of 25° C. and a relative humidity of 50% to make sure the cleanness.

The cleanness was evaluated by confirming the formed images by eyes, i.e., by testing the vividness at the boundary portion between the image portion and the non-image portion and the presence of black stripes formed by the leakage of toner in the direction in which the photoreceptor drum rotates and by finding the fogging amount Wk by using a measuring instrument that will be described later in each of the stages of prior to forming the image (initial stage), after having printed 5,000 pieces (5K pieces) and after having printed 10,000 pieces (10K pieces). The fogging amount Wk of the formed image was found as described below by measuring the reflect ion density by using a color difference meter (trade name: Z-Σ90 Color Measuring System, manufactured by Nippon Denshoku Industries Co., Ltd.) That is, the average reflection density Wr of the recording paper was measured, first, prior to forming the image. Next, the image was formed by the recording portion and after the image was formed, the reflection density was measured on various white portions of the recorded paper. From the portion decided to be most fogging, i.e., from the reflection density Ws of the most dense port on despite of the white portion and from the above average reflection density Wr, a value found in compliance with the following formula (2) was defined to be the fogging amount Wk(%). The evaluation was made on the following basis.

$$Wk=100\times(Ws-Wr)/Wr \quad (2)$$

Excellent: Very favorable. Highly vivid, no black stripes, and the fogging amount Wk is less than 3%.

Good: Favorable. Highly vivid, no black stripes, and the fogging amount Wk is not less than 3% but is less than 5%.

Not Bad: Practicably no problem. Practically, vividness is without problem. Black stripes are not longer than 2.0 mm, its number is not more than 5, and the fogging amount Wk is not less than 5% but is less than 10%.

Poor: Not practically usable. Practicably, vividness is poor. Either, the black stripes are not shorter than 2.0 nm or its number is not less than 6. The fogging amount Wk is not less than 10%.

[Charge Stability]

5 Parts of the toner and 95 parts of the ferrite core carrier having a volume average particle size of 45 μm were mixed together, and were kneaded by using a desk-top ball mill (manufactured by Tokyo Glass Kikai Kabushiki Kaisha) in an environment of a normal temperature and a normal humidity, i.e., a temperature of 25° C. and a relative humidity of 50% for 30 minutes to measure the initial amount of electric charge of the toner. By using the two-component developers containing the toners of Examples and Comparative Examples and the commercially available copying machine (trade name: MX-3500, manufactured by Sharp Corporation), further, a text chart having a coverage of 5% was printed onto 10,000 pieces of paper to measure the amount of electric charge of the toners.

The toner was measured for its amount of electric charge by using a device for measuring the amount of electric charge (trade name: MODEL 210HS-2A, manufactured by Trek Japan Co., Ltd.) in a manner as described below. A mixture of the ferrite particles collected from the ball mil and the toner was introduced into a metallic container having, on the bottom portion thereof, an electrically conducting screen of 795 mesh, and the toner only was sucked by a sucking device with a sucking pressure of 250 mmHg in order to find the amount of electric charge of the toner from a difference in weight between the weight of the mixture before the suction and the weight of the mixture after the suction, and a potential difference between the capacitor electrodes connected to the container. The attenuation factor of the amount of electric charge of the toner was found in compliance with the following formula (3), wherein $Q_{ini}$ de notes the initial amount of electric charge of the toner and Q denotes the amount of electric charge of the toner after having printed 10,000 pieces of paper.

$$\text{Attenuation factor of amount of electric charge of toner} = 100 \times (Q - Q_{ini})/Q_{ini} \quad (3)$$

The evaluation was made on the following basis. The lower the attenuation factor, the more stable the amount of electric charge.

Excellent: The attenuation factor of the amount of electric charge is less than 5%.

Good: The attenuation factor of the amount of electric charge is not less than 5% but is less than 10%.

Not Bad: The attenuation factor of the amount of electric charge is not less than 10% but is less than 15%.

Poor: The attenuation factor of the amount of electric charge is not less than 15%.

[Comprehensive Evaluation]

The Comprehensive evaluation was made on the following basis.

Excellent: Very favorable. There is no result of the evaluation "Not Bad" or "Poor".

Good: Favorable. There is not result of the evaluation "Poor" but there are one to three results of the evaluation "Not Bad".

Not Bad: Practically no problem. There is no result of the evaluation "Poor" but there are not less than four results of the evaluation "Not Bad".

Poor: No Good. There is the result of the evaluation "Poor".

Table 3 shows the results of evaluation and the results of total evaluation of Examples 1 to 19 and Comparative Examples 1 to 3.

TABLE 3

| | While spot | Resolution | Transfer efficiency | Cleanness | Charge stability | Comprehensive evaluation |
|---|---|---|---|---|---|---|
| Example 1 | Excellent | Good | Excellent | Excellent | Excellent | Excellent |
| Example 2 | Excellent | Good | Excellent | Excellent | Excellent | Excellent |
| Example 3 | Excellent | Good | Excellent | Excellent | Excellent | Excellent |
| Example 4 | Excellent | Good | Excellent | Excellent | Excellent | Excellent |
| Example 5 | Excellent | Good | Excellent | Excellent | Excellent | Excellent |
| Example 6 | Excellent | Good | Excellent | Excellent | Good | Excellent |
| Example 7 | Excellent | Good | Excellent | Excellent | Good | Excellent |
| Example 8 | Excellent | Good | Good | Excellent | Good | Excellent |
| Example 9 | Excellent | Good | Excellent | Excellent | Excellent | Excellent |
| Example 10 | Excellent | Good | Good | Excellent | Excellent | Excellent |
| Example 11 | Excellent | Good | Good | Excellent | Excellent | Excellent |
| Example 12 | Excellent | Excellent | Excellent | Excellent | Excellent | Excellent |
| Example 13 | Good | Good | Good | Good | Excellent | Excellent |
| Example 14 | Excellent | Excellent | Excellent | Excellent | Excellent | Excellent |
| Example 15 | Excellent | Excellent | Good | Excellent | Good | Excellent |
| Example 16 | Good | Good | Good | Excellent | Good | Excellent |
| Example 17 | Excellent | Excellent | Excellent | Excellent | Excellent | Excellent |
| Example 18 | Excellent | Good | Excellent | Excellent | Excellent | Excellent |
| Example 19 | Excellent | Good | Excellent | Excellent | Excellent | Excellent |
| Comparative Example 1 | Excellent | Excellent | Excellent | Excellent | Poor | Poor |
| Comparative Example 2 | Not Bad | Poor | Not Bad | Not Bad | Excellent | Poor |
| Comparative Example 3 | Excellent | Poor | Excellent | Excellent | Excellent | Poor |

The toners of Examples 1 to 19 were comprehensively evaluated to be very favorable.

In the toner of Comparative Example 1, the fine silicon-containing oxide particles contained water in an amount of not less than 2.0%. Therefore, the electric charge leaked into the carrier surfaces via the fine silicon-containing oxide particles, the amount of specific charge of the toner decreased, and the charge stability became low.

In the toner of Comparative Example 2, the average primary particle size of the fine silicon-containing oxide particles was less than 70 nm, and the cleanness was low. Further, the amount of fine particles of small particle sizes has increased impairing fixing property and lowering the heat-transfer efficiency. Therefore, the resolution of the image, too, was low.

In the toner of Comparative Example 3, the amount of particles of large particle sizes has increased; i.e., the fine silicon-containing oxide particles possessed an average primary particle size in excess of 150 nm. Therefore, contact was defective between the toner and the carrier, the toner possessed a decreased amount of specific charge, and the resolution was low.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

We claim:

1. A method of manufacturing a toner comprising:

a step of producing a fine silicone-containing oxide particles by a sol-gel method including drying and spheroidizing, a step of heating the fine silicone-containing oxide particles to 2.0% or less of the water content in the fine silicone-containing oxide particles, a step of imparting hydrophobic property to the fine silicone-containing oxide particles obtained by the heating step by hydrophobic property-imparting treatment, and a step of externally adding the fine silicone-containing oxide particles obtained by the imparting hydrophobic property step to a toner particles by mixing the toner particles and the fine silicone-containing oxide particles, wherein the toner comprises of the toner particles containing at least a binder resin and a coloring agent; and the silicone-containing oxide particles having an average primary particle size of not smaller than 70 nm but not larger than 150 nm and containing water in an amount of not larger than 2.0% by weight.

2. The method of claim 1, wherein a particle size distribution of the fine silicone-containing oxide particles is a monodispersion.

3. The method of claim 1, wherein the fine silicone-containing oxide particles have a specific surface area of not smaller than 20 $m^2/g$ but not larger than 50 $m^2/g$.

4. The method of claim 1, wherein the hydrophobic property-imparted fine silicone-containing oxide particles are added in an amount of not less than 0.5 part by weight but not more than 3.0 parts by weight based on 100 parts by weight of the toner particles.

5. The method of claim 1, wherein the toner has a volume average particle size of not smaller than 4 μm but not larger than 8 μm.

6. The method of claim 1, wherein the toner comprises one or more of fine particles having an average primary particle size smaller than that of the fine silicone-containing oxide particles.

7. The method of claim 1, wherein the fine silicone-containing oxide particles are heated at 1000° C.

* * * * *